US011913707B2

(12) United States Patent
Gagnon et al.

(10) Patent No.: US 11,913,707 B2
(45) Date of Patent: Feb. 27, 2024

(54) CONTAINER ASSEMBLY AND LID THEREFOR WITH THERMAL RESERVOIR

(71) Applicant: California Innovations Inc., Toronto (CA)

(72) Inventors: Guy Gagnon, Boisbriand (CA); Yongbing Guo, Shenzhen (CN)

(73) Assignee: CALIFORNIA INNOVATIONS INC. (CA)

( * ) Notice: Subject to any disclaimer, the term of this patent is extended or adjusted under 35 U.S.C. 154(b) by 51 days.

(21) Appl. No.: 17/151,497

(22) Filed: Jan. 18, 2021

(65) Prior Publication Data

US 2022/0228793 A1 Jul. 21, 2022

(51) Int. Cl.

| | |
|---|---|
| ***F25D 23/02*** | (2006.01) |
| ***F25D 3/08*** | (2006.01) |
| ***B65D 51/24*** | (2006.01) |
| ***B65D 81/38*** | (2006.01) |
| ***B65D 43/16*** | (2006.01) |

(52) U.S. Cl.

CPC ..... *F25D 23/02* (2013.01); *B65D 51/24* (2013.01); *B65D 81/382* (2013.01); *F25D 3/08* (2013.01); *B65D 43/16* (2013.01); *B65D 2543/0049* (2013.01); *B65D 2543/00222* (2013.01); *B65D 2543/00833* (2013.01); *F25D 2303/0831* (2013.01)

(58) Field of Classification Search

CPC ..... A45C 11/20; A45C 3/00; A45C 13/02; A45C 3/001; A45C 2005/037; B65D 81/3897; B65D 81/38; B65D 81/3825; F25D 3/08; F25D 2331/804

USPC .... 220/521, 523, 522, 142, 951.2, 212, 623, 220/608; 62/457.9

See application file for complete search history.

(56) References Cited

U.S. PATENT DOCUMENTS

| | | | | |
|---|---|---|---|---|
| 1,551,709 | A * | 9/1925 | Stoll | F25D 7/00 62/297 |
| 2,289,254 | A | 10/1940 | Eagles | |
| 2,672,232 | A * | 3/1954 | Kessell, Jr. | A45C 11/20 220/521 |
| 2,767,039 | A * | 10/1956 | Danna, Jr. | F25D 25/00 220/348 |
| 4,024,731 | A * | 5/1977 | Branscum | F25D 3/00 215/385 |
| 4,211,091 | A | 7/1980 | Campbell | |
| 4,311,022 | A | 1/1982 | Hall | |

(Continued)

*Primary Examiner* — Steven A. Reynolds
*Assistant Examiner* — Prince Pal
(74) *Attorney, Agent, or Firm* — OSTROLENK FABER LLP

(57) ABSTRACT

A cooler has a body and a lid that co-operate. The lid is movable between closed and open positions. The lid is a freezable reservoir. A filler port is located inside the lid. The entrance of the filler port into the lid is located at a height part way between the inside and outside walls of the lid. The lid has a downwardly extending hollow peripheral formation. The filler port is spanwise inset from the peripheral formation. The lid has spanwise extending internal formations that stiffen the lid and divide the internal chamber into sub-volumes connected by necks through which liquid can flow. The inside and outside walls of the lid may be connected. The lid is provided with a "fill to" line visible from the filling port to discourage over-filling. The lid may have an insulated cap, and the cooler may have an insulated jacket.

24 Claims, 13 Drawing Sheets

(56) References Cited

U.S. PATENT DOCUMENTS 4,324,111 A 4/1982 Edwards
4,509,645 A 4/1985 Hotta
4,517,815 A 5/1985 Basso
4,537,313 A 8/1985 Workman
4,592,482 A * 6/1986 Seager ..... A45C 11/20 220/756
4,679,242 A 7/1987 Brockhaus
4,741,176 A 5/1988 Johnson et al.
4,831,842 A 5/1989 Kelley et al.
4,892,226 A 1/1990 Abtahi
5,050,387 A * 9/1991 Bruce ..... F25D 3/06 62/457.2
D328,550 S 8/1992 Mogil et al.
D335,957 S 6/1993 Cantrell et al.
5,235,819 A * 8/1993 Bruce ..... F25D 3/06 62/530
5,237,838 A 8/1993 Merritt-Munson
5,337,911 A * 8/1994 Holub ..... A45C 11/20 220/254.3
5,354,131 A 10/1994 Mogil
5,361,603 A 11/1994 Merritt-Munson
5,403,095 A 4/1995 Melk
5,490,396 A 2/1996 Morris
5,562,228 A 10/1996 Ericson
D375,629 S 11/1996 Chen
D382,771 S 8/1997 Mogil
D382,772 S 8/1997 Mogil
D387,249 S 12/1997 Mogil
5,857,778 A 1/1999 Ells
5,865,314 A 2/1999 Jacober
D408,225 S 4/1999 Hodosh
5,904,230 A 5/1999 Peterson
5,924,303 A 7/1999 Hodosh
5,974,826 A 11/1999 Baldwin et al.
D419,770 S 2/2000 Mogil
6,027,249 A 2/2000 Bielinski
D421,366 S 3/2000 Mogil
6,067,816 A 5/2000 Hodosh
6,068,402 A 5/2000 Freese et al.
6,073,796 A 6/2000 Mogil
6,092,661 A 7/2000 Mogil
6,116,045 A 9/2000 Hodosh et al.
D435,342 S 12/2000 Mogil
D435,968 S 1/2001 Mogil
D436,442 S 1/2001 Mogil
6,213,268 B1 4/2001 Dancyger
6,234,677 B1 5/2001 Mogil
6,237,776 B1 5/2001 Mogil
6,238,091 B1 5/2001 Mogil
6,247,328 B1 6/2001 Mogil
D446,937 S 8/2001 Mogil
6,315,149 B1 * 11/2001 Conrado ..... A45C 5/14 220/592.2
D452,075 S 12/2001 Mogil
D453,625 S 2/2002 Mogil
6,363,739 B1 4/2002 Hodosh
6,422,032 B1 7/2002 Greene
6,439,389 B1 8/2002 Mogil
6,474,095 B1 11/2002 Chan
6,474,097 B2 * 11/2002 Treppedi ..... F25D 3/08 280/30
6,481,239 B2 11/2002 Hodosh
6,513,661 B1 2/2003 Mogil
6,582,124 B2 6/2003 Mogil
6,644,063 B2 11/2003 Mogil
6,821,019 B2 11/2004 Mogil
6,925,834 B2 8/2005 Fuchs
D534,771 S * 1/2007 Zorn ..... D7/605
7,162,890 B2 1/2007 Mogil
D560,102 S * 1/2008 Sumter ..... D7/605
7,597,478 B2 10/2009 Pruchnicki
7,669,436 B2 3/2010 Mogil
7,682,080 B2 3/2010 Mogil
7,721,566 B1 5/2010 Wilken
7,757,878 B2 7/2010 Mogil
D620,707 S 8/2010 Mogil
D627,199 S 11/2010 Pruchnicki
7,841,207 B2 11/2010 Mogil
D635,828 S 4/2011 Pruchnicki
7,988,006 B2 8/2011 Mogil
8,043,004 B2 10/2011 Mogil
8,061,159 B2 11/2011 Mogil
8,096,442 B2 1/2012 Ramundi
D657,632 S 4/2012 Pruchnicki
8,191,747 B2 6/2012 Pruchnicki
8,209,995 B2 7/2012 Kieling et al.
8,348,510 B2 1/2013 Mogil
8,459,058 B2 6/2013 Mogil
8,640,937 B2 2/2014 Pruchnicki
8,646,970 B2 2/2014 Mogil
8,764,017 B2 * 7/2014 Manner ..... A63F 9/001 273/400
8,777,045 B2 7/2014 Mitchell
8,857,654 B2 10/2014 Mogil
8,887,942 B2 * 11/2014 Miksovsky ..... A45F 3/20 220/666
8,899,071 B2 12/2014 Mogil
9,209,995 B2 12/2015 Ansari et al.
9,271,553 B2 3/2016 Ponx
9,310,118 B2 * 4/2016 Zavitsanos ..... F25D 3/08
9,366,467 B2 * 6/2016 Kiedaisch ..... F25D 3/00
9,408,445 B2 8/2016 Mogil
9,422,099 B2 8/2016 Mitchell
9,254,022 B2 9/2016 Meldeau et al.
9,809,376 B2 11/2017 Mitchell
9,868,583 B2 1/2018 Mitchell
10,065,848 B2 * 9/2018 Volin ..... F25D 31/006
10,098,427 B2 10/2018 Mogil
10,138,048 B2 11/2018 Mitchell
10,287,055 B2 5/2019 Barattin
10,314,377 B2 6/2019 Stephens
10,345,026 B2 * 7/2019 Fire ..... B67D 1/0086
10,443,918 B2 * 10/2019 Li ..... F25D 3/08
10,506,895 B2 12/2019 Mogil et al.
10,730,684 B2 8/2020 Mitchell
10,731,919 B1 * 8/2020 Gutierrez ..... F25D 27/005
10,806,225 B2 10/2020 Sitnikova
D904,829 S * 12/2020 Nichols ..... D7/605
11,027,885 B2 * 6/2021 Duong ..... B62B 1/186
11,096,463 B2 8/2021 Stephens
11,097,887 B2 8/2021 Mogil
11,414,256 B2 * 8/2022 Fabela ..... B65D 43/164
2004/0178208 A1 * 9/2004 Leba ..... F25D 3/08 220/761
2005/0198992 A1 9/2005 Mogil
2006/0163263 A1 * 7/2006 Helline ..... F25D 3/08 220/592.03
2007/0006376 A1 * 1/2007 Bartosik ..... A61H 33/6026 4/541.1
2007/0237432 A1 10/2007 Mogil
2008/0245793 A1 * 10/2008 Hanson ..... A45C 11/20 220/592.2
2009/0032153 A1 2/2009 Burnett
2009/0095757 A1 4/2009 Ramundi
2009/0184143 A1 7/2009 Witt et al.
2009/0301511 A1 12/2009 Vinci
2010/0089929 A1 4/2010 Ramundi
2010/0212351 A1 * 8/2010 Chapin ..... F25D 3/08 222/131
2011/0259898 A1 * 10/2011 Mogil ..... A45C 11/20 62/457.7
2013/0008897 A1 * 1/2013 Rusnak ..... B65D 43/0231 220/254.7
2015/0114024 A1 * 4/2015 Grepper ..... B65D 81/3813 220/592.2
2015/0238033 A1 * 8/2015 Zavitsanos ..... A45C 11/20 220/592.2
2015/0253056 A1 9/2015 Richardson
2015/0375918 A1 * 12/2015 Holderness ..... B67D 3/0067 220/592.2
2017/0003063 A1 * 1/2017 Jackson ..... F25D 3/08
2017/0119116 A1 * 5/2017 Bradley ..... A45C 13/36

(56) References Cited

U.S. PATENT DOCUMENTS

| | | | | |
|---|---|---|---|---|
| 2018/0186528 | A1* | 7/2018 | Tonn | G01F 11/16 |
| 2018/0335241 | A1* | 11/2018 | Li | B65D 25/06 |
| 2019/0241349 | A1* | 8/2019 | Pearson | B65D 81/3813 |
| 2019/0330041 | A1* | 10/2019 | Fire | B67D 1/0075 |
| 2021/0024276 | A1* | 1/2021 | Bradley | A45C 13/36 |
| 2021/0235933 | A1* | 8/2021 | Ma | B65D 81/3823 |

* cited by examiner

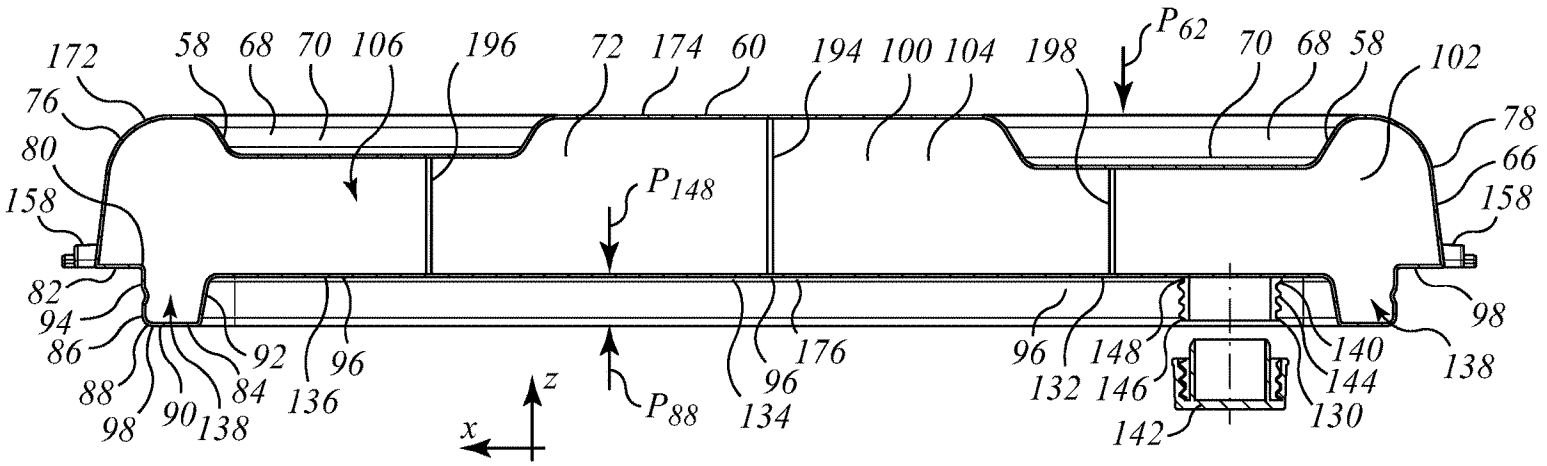
Fig. 3e
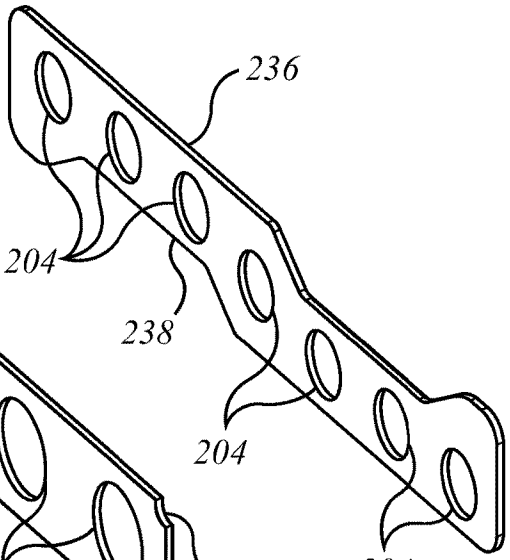
Fig. 3i
Fig. 3h
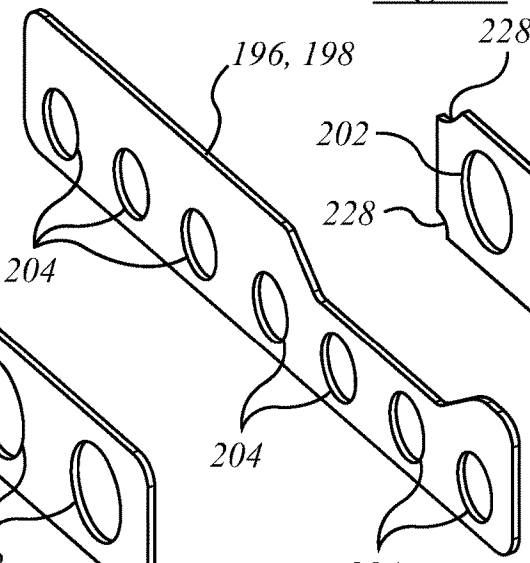
Fig. 3g
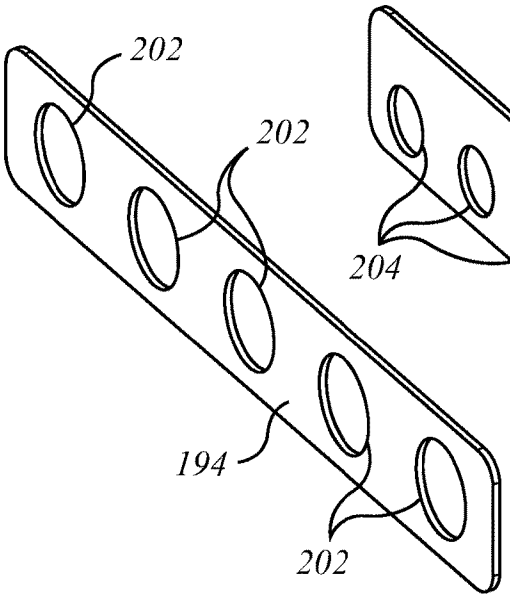
Fig. 3f

CONTAINER ASSEMBLY AND LID THEREFOR WITH THERMAL RESERVOIR

FIELD OF THE INVENTION

This invention relates to the field of portable containers having thermal storage reservoirs.

BACKGROUND OF THE INVENTION

Insulated coolers may have a generally box-shaped form, with the lid of the box being movable between closed and open positions to govern access to the cooler. The lid fits the body closely so the contents of the cooler are kept cool, or, in some instances, warm. Some coolers come with phase changing ice-packs that can be frozen in the refrigerator and then placed in the cooler for use. It would be helpful to be able to fill the lid with ice, and to use it as a thermal reservoir to keep the container cooler longer. Molded plastic parts may tend to deform if over-filled and frozen. It may be helpful then, not to overfill the reservoir and for the filler port to be appropriately located and oriented.

SUMMARY OF THE INVENTION

In an aspect of the invention there is a container lid. It has a hollow body that defines an internal chamber or reservoir. The reservoir has a filler port on the inside of the lid. In use, the filler port is inverted. In another aspect of the invention, there is a cooler lid that has a hollow body. It has an outside wall, an inside wall, and a peripheral wall joining the outside wall to the inside wall. The outside wall, inside wall, and peripheral wall defining boundaries of an internal chamber of the lid. The internal chamber has a filler port. The filler port is inset from the peripheral wall. The filler port has an entrance to the chamber that is intermediate the outside wall and the inside wall. Without regard to orientation of the lid, a first portion of volume of the chamber lies at a level above the entrance of the filler port, and a second portion of volume of the chamber lies at a level below the entrance of the filler port.

In a feature of that aspect, the cooler lid has a "fill-to" line formed therein. The "fill-to" line is visible from the filler port. In a further feature, the cooler lid has a projected volumetric envelope. The filler port has a filler pipe. It is contained within the projected volumetric envelope. In a further feature, the filler pipe is mounted to the inside wall of the lid. When the lid is placed upside-down on its outer wall, the filler pipe opens predominantly upward.

In another feature, the inside wall includes a peripheral formed section. The peripheral formed section is hollow to define a cavity therewithin. The cavity is in fluid communication with the chamber and forming a portion thereof. When the lid is lying upside-down on the outside wall, the cavity of the peripheral formed section is located predominantly upwardly of the entrance of the filler port into the chamber. In yet another feature, the inside wall has a peripherally extending structural section. The structural section including a hollow channel. The hollow channel is in fluid communication with and is part of the chamber. The channel has a back and a pair of spaced apart legs. The inside wall has a spanning membrane, or web, that extends front to rear and left to right. The channel merges into the inside wall and stands away from the outside wall. When the lid is mounted on a mating container, the entrance of the filler port into the chamber is higher than the hollow channel and lower than the outside wall.

In a further feature, at least one of (a) the outside wall; and (b) the inside wall, has at least a first out-of-plane formation formed therein. In yet another feature, the chamber has at least a first portion, a second portion, and a neck defined between the first portion and the second portion. In another feature, the lid is rectangular in plan view, and the inside wall has at least one span-wise stiffener formed therein. The at least one span-wise stiffener extending one of (a) front to rear; and (b) left to right. The span-wise stiffener is structurally connected to the outer wall. The chamber is divided into at least first and second portions by the at least one span-wise stiffener. The first and second regions of the chamber is linked by a neck. In another feature, the lid has an insulated cover that mates with the outside wall thereof. In still another feature, the lid is removably separable from the insulated cover.

In another aspect, there is a cooler lid. The cooler lid has a hollow body has an outside wall, an inside wall, and a peripheral wall joining the outside wall to the inside wall. The inside wall has a land for mating engagement with a cooler body. The outside wall, inside wall, and peripheral wall define boundaries of an internal chamber of the lid. The internal chamber has a filler port. The inside wall has a peripheral formation. The peripheral formation includes a land that, in use, engages a mating container body. The inside wall has at least one stiffener extending one of (a) spanwise in a front-to-rear direction; and (b) spanwise in a left-to-right direction. The at least one stiffener divides the internal chamber into at least a first portion and a second portion. The first portion and the second portion are joined by a neck.

In a feature of that aspect, the peripheral formation is hollow and has a cavity formed therewithin. The cavity is joined to, and forms part of, the internal chamber. When the cooler lid sits on the cooler body, the peripheral formation defines a channel. The channel of the peripheral formation has a back. The back extends downwardly. The at least one spanwise formation defines a channel that has a back that extends upwardly.

In another feature, the at least one spanwise formation defines at least one spanwise extending channel has a back and a pair of legs, the legs extending downwardly of the back of the spanwise extending channel. The peripheral formation defines a peripheral channel. The peripheral channel has a back, an inner leg and an outer leg. The inner leg and the outer leg extend upwardly from the back of the peripheral channel. The inner wall has at least one spanwise extending web. The at least one spanwise extending web is bounded by a combination of the at least one spanwise formation and at least one portion of the peripheral formation. The inner leg of the peripheral channel merges with the at least one spanwise extending web and extending downwardly therefrom. At least one of the legs of the channel of the at least one spanwise formation merges with the spanwise extending web and extends upwardly therefrom.

In a further feature, the inside wall of the lid has at least a first spanwise extending web and a second spanwise extending web. A first of the spanwise extending formations is located between, and bounds, one edge of each of the first spanwise extending web and the second spanwise extending web. The peripheral formation bounds at least two other edges of the first spanwise extending web. The filler port is mounted to the first spanwise extending web. In still another feature, the at least one spanwise formation is structurally interconnected to the outside wall at a location inwardly distant from the peripheral formation.

In another feature, the outside wall has at least a first out-of-contour formation formed therein, the first out-of-contour formation defining a drink pocket. In still another feature, the at least one spanwise extending formation of the inside wall has a locally extending portion connecting it to the drink pocket of the outside wall.

In another feature, the cooler lid has a removable insulated cover. In yet another feature, the outside wall has a contour. The inside wall has a contour. The at least one spanwise extending formation extends upwardly out-of-contour relative to the inside wall. The peripheral formation extends downwardly out-of-contour relative to the inside wall. The filler port is mounted flush with the contour of the inside wall.

The features of the aspects of the invention may be mixed and matched as appropriate without need for multiplication and repetition of all possible permutations and combinations.

BRIEF DESCRIPTION OF THE DRAWINGS

These and other aspects and features of the invention may be more readily understood with the aid of the illustrative Figures below, showing an example, or examples, embodying the various aspects and features of the invention, provided by way of illustration, and in which.

Figure 1A:
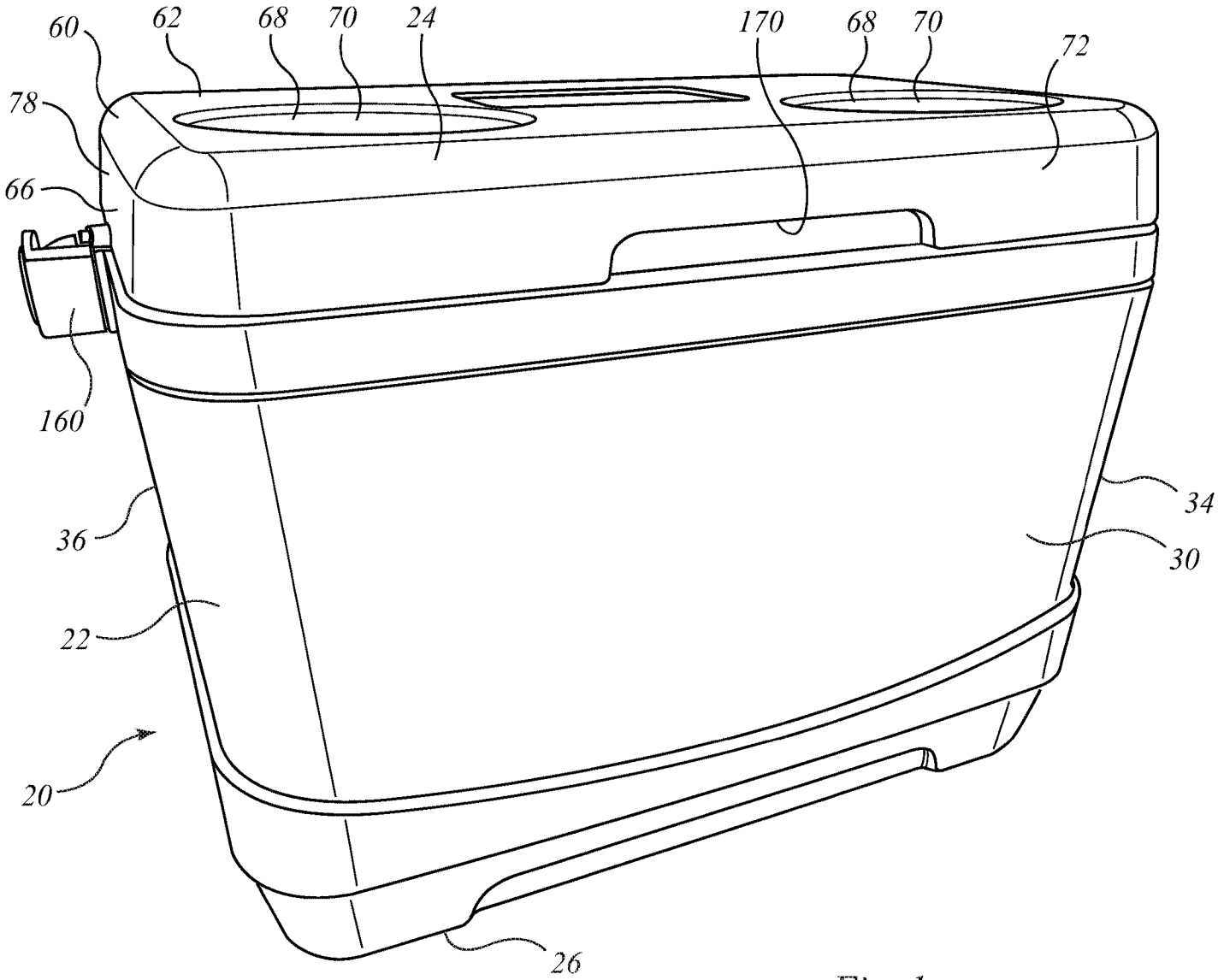
FIG. 1*a* is a perspective view of a cooler assembly that includes a container lid and a mating container body.
Figure 1B:
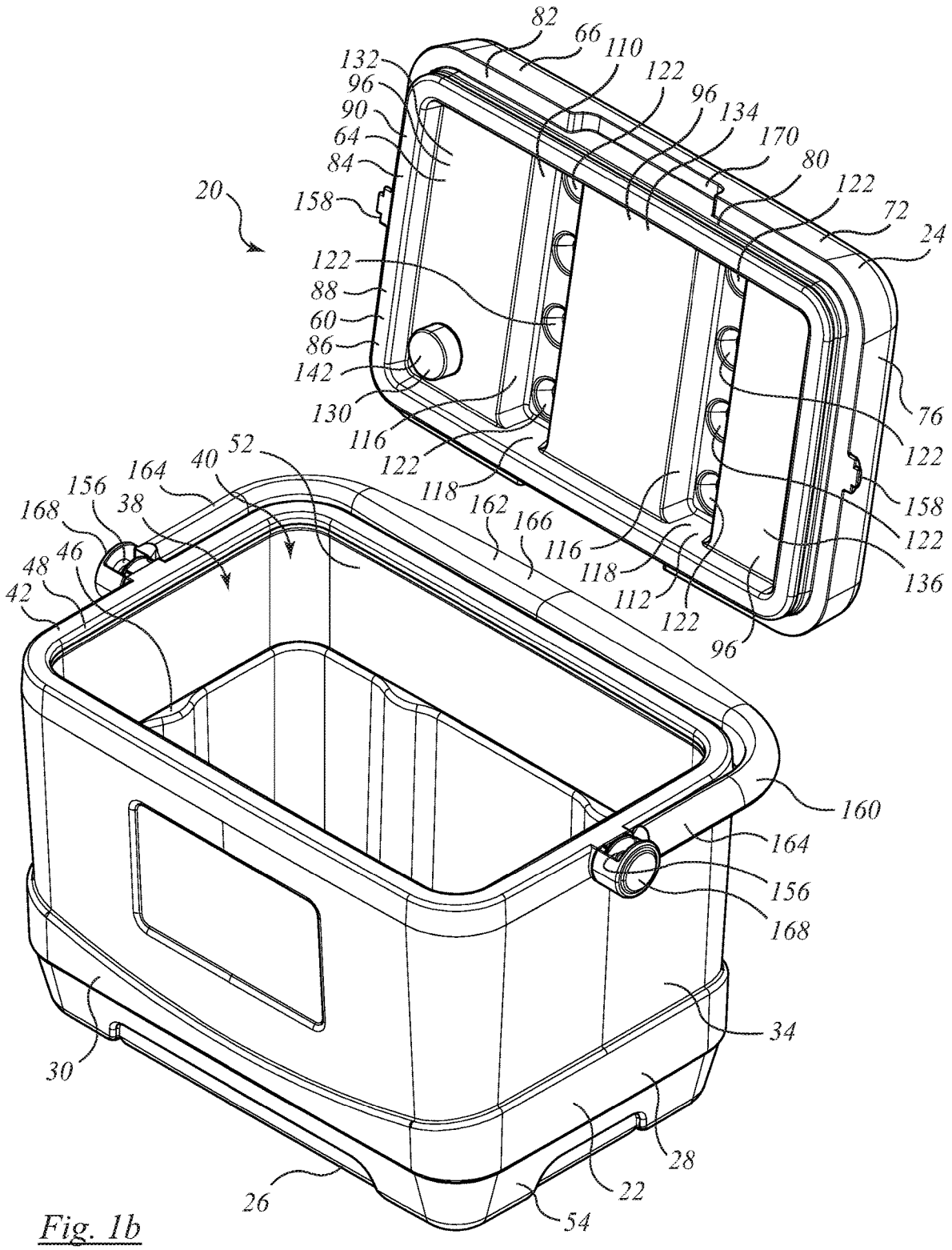
FIG. 1*b* is a perspective view of the cooler assembly of FIG. 1*a* with the lid open.
Figure 1C:
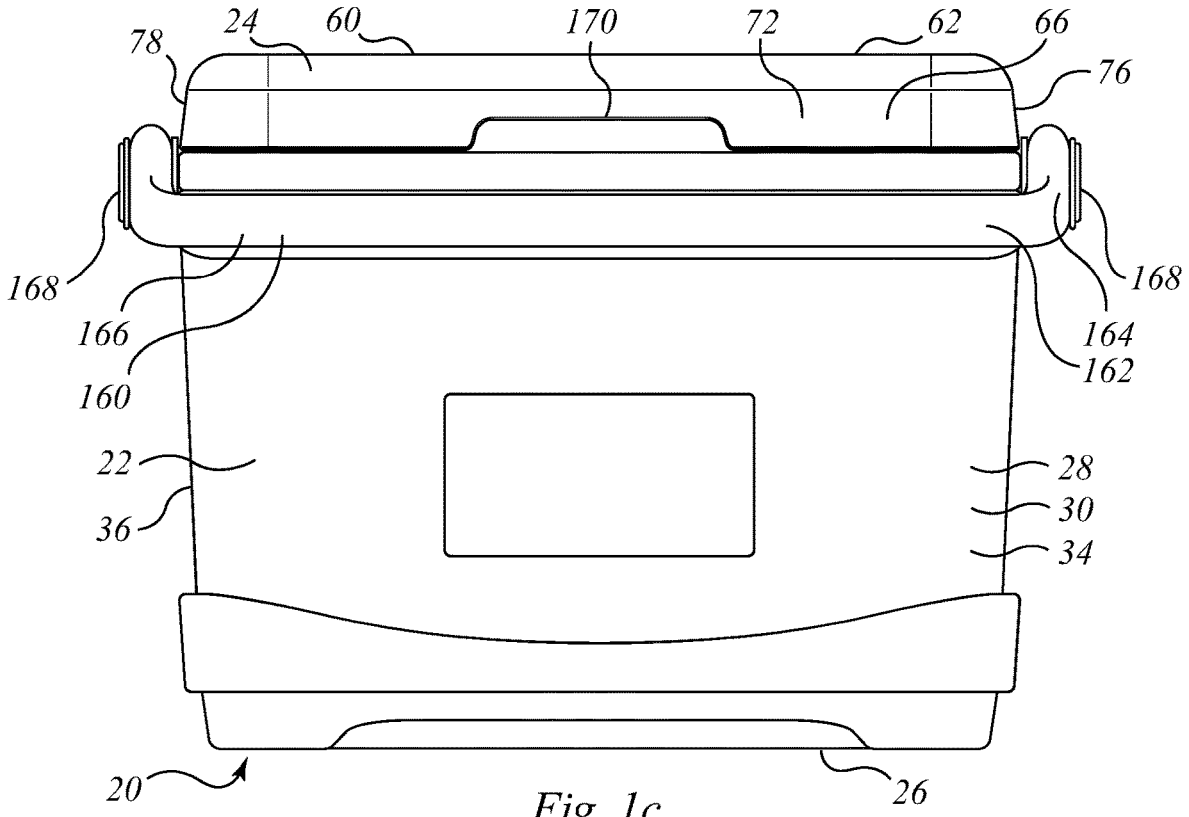
FIG. 1*c* is a front view of the cooler assembly of FIG. 1*a;*
Figure 1D:
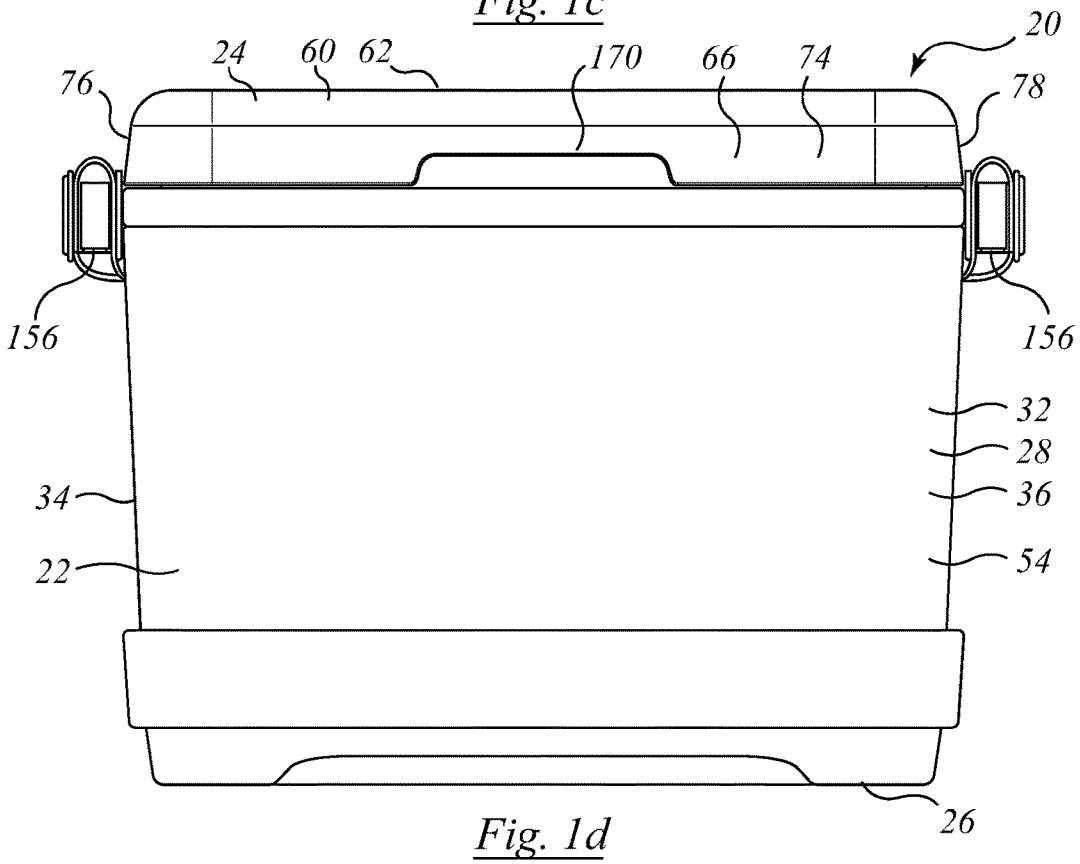
FIG. 1*d* is a rear view of the cooler assembly of FIG. 1*a;*
Figure 1F:
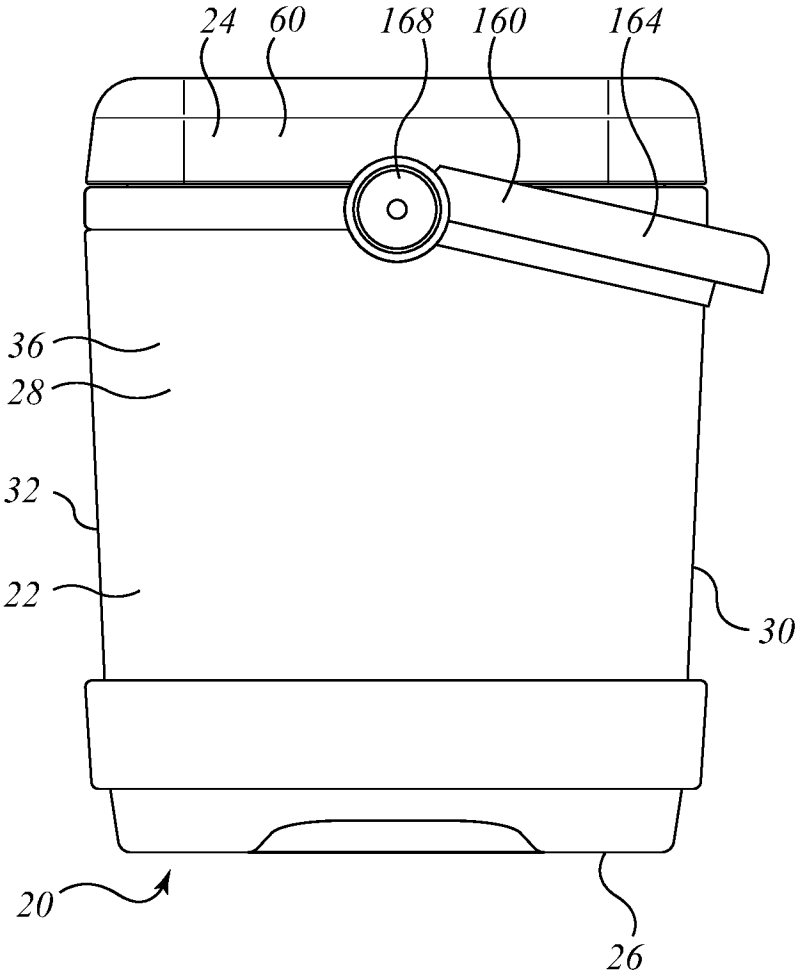
FIG. 1*e* is a left-hand side view of the cooler assembly of FIG. 1*a;*
Figure 1E:
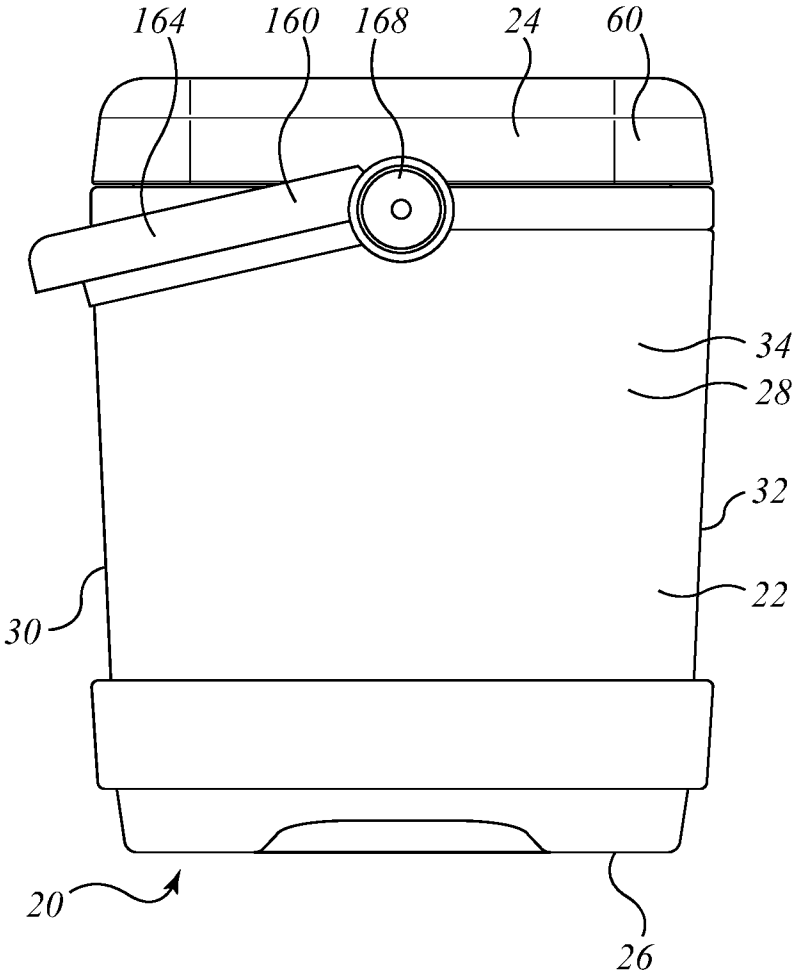

Figure if is a right-hand side view of the cooler assembly of FIG. 1*a;*

Figure 2A:
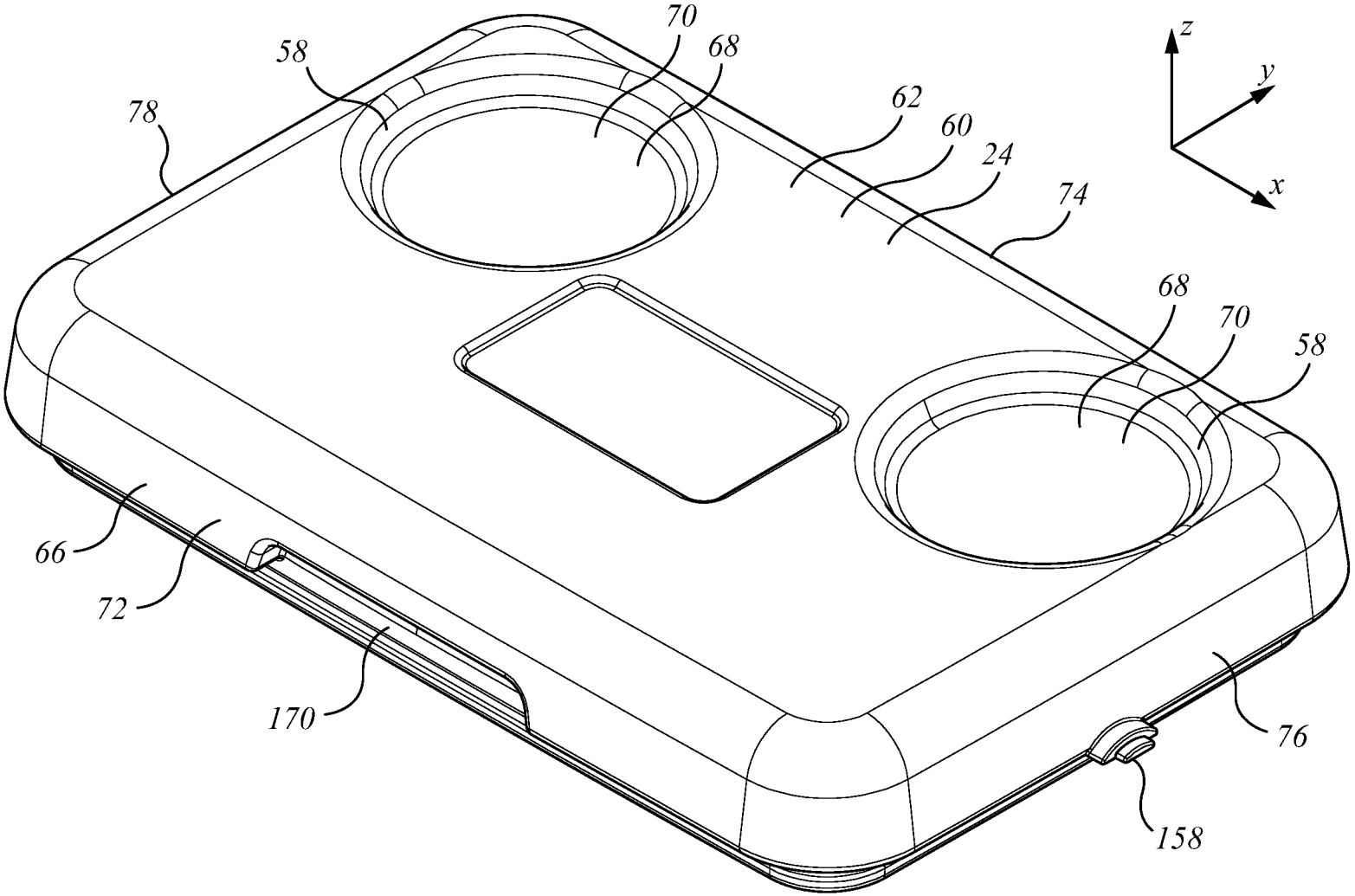

FIG. 2*a* is an isometric view of the lid of the container assembly of FIG. 1*a;*

Figure 2B:
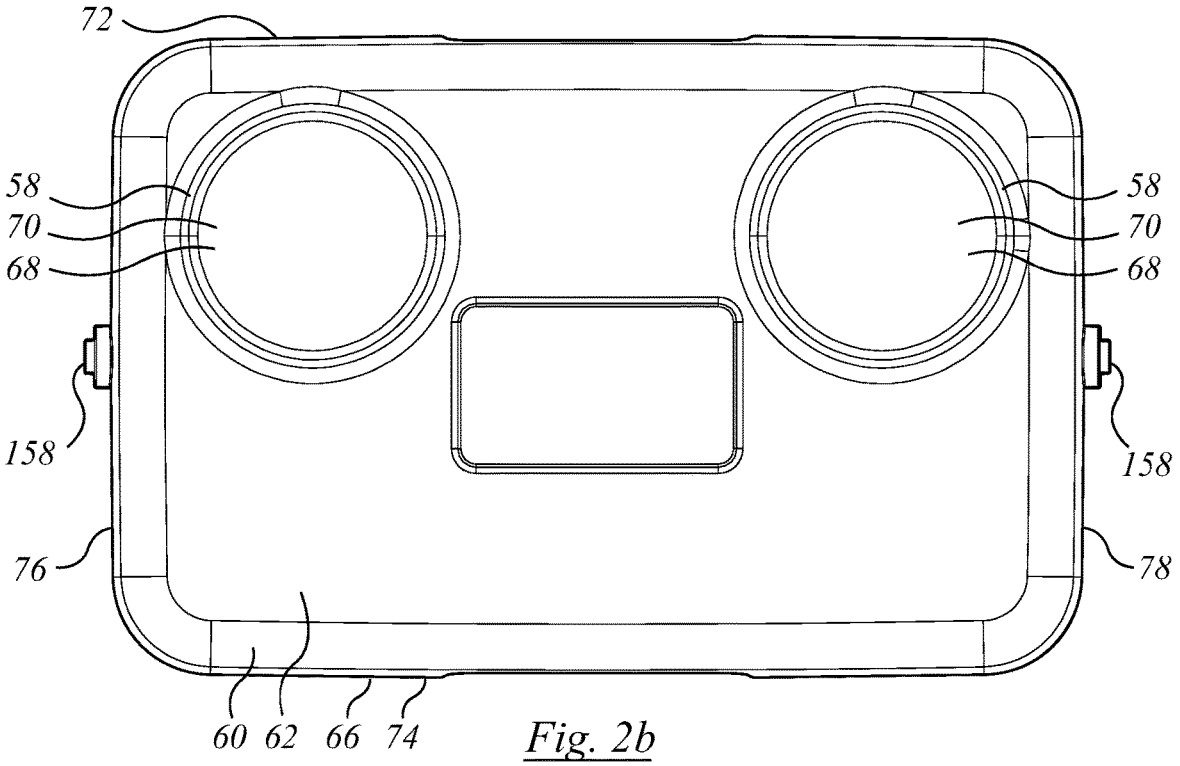

FIG. 2*b* is a top view of the container lid assembly of FIG. 2*a;*

Figure 2C:
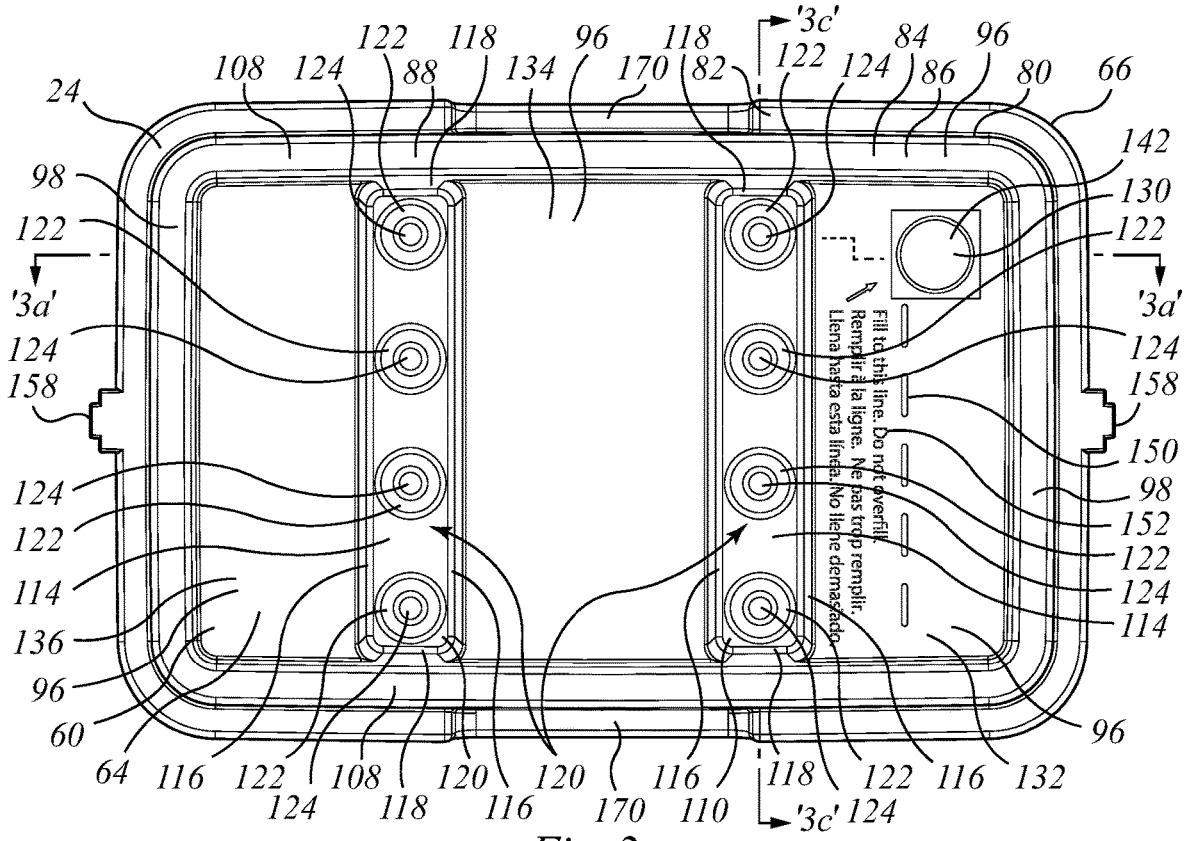

FIG. 2*c* is a bottom view of the container lid assembly of FIG. 2*a;*

Figure 2D:
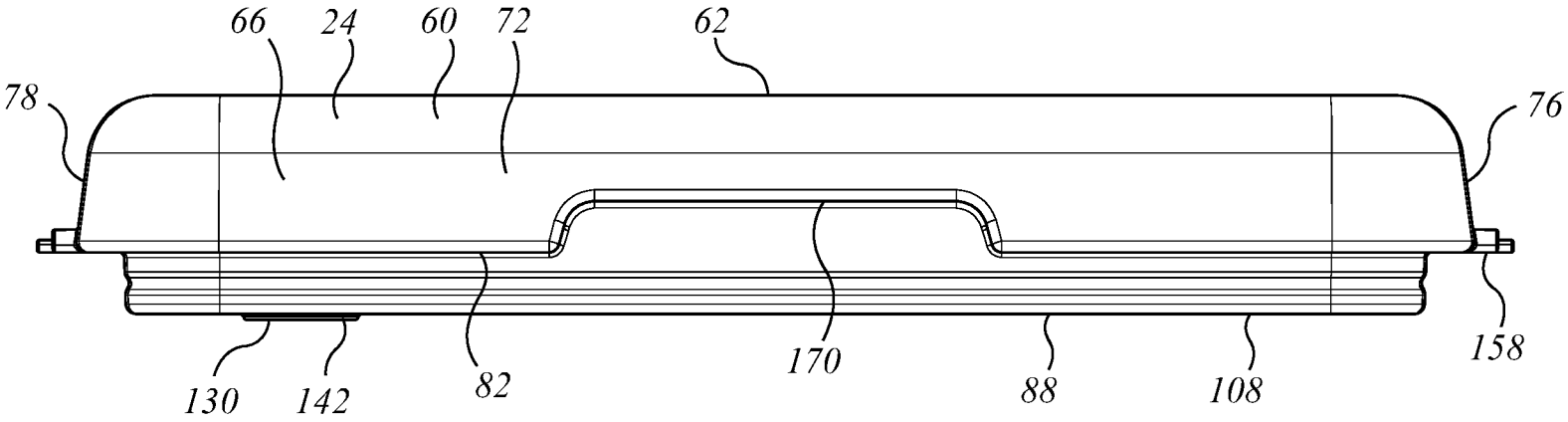

FIG. 2*d* is a front view of the container lid assembly of FIG. 2*a;*

Figure 2E:
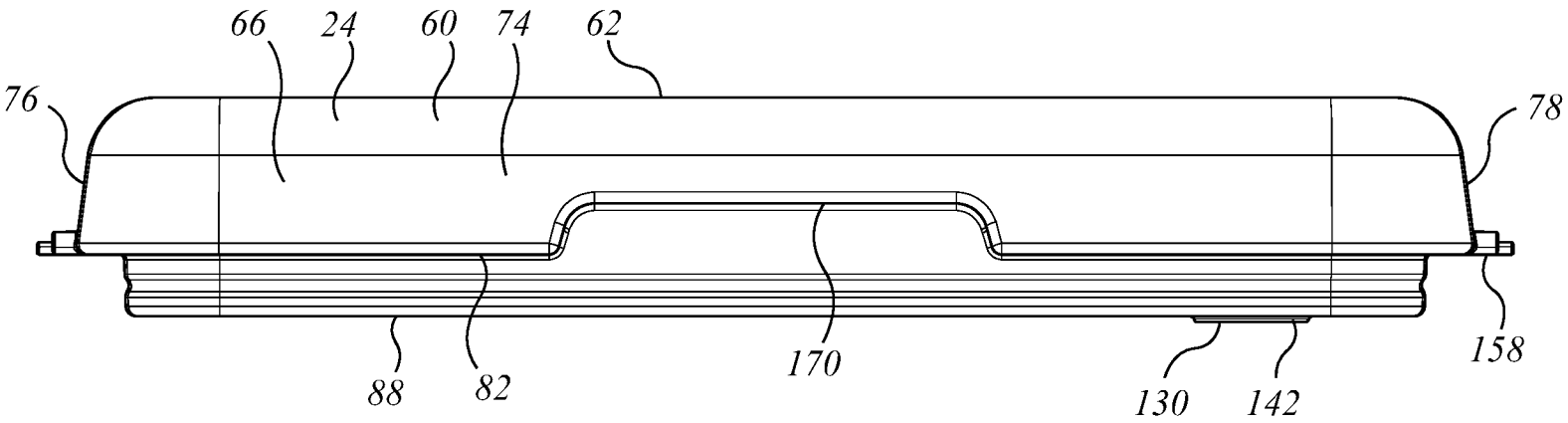

FIG. 2*e* is a rear view of the container lid assembly of FIG. 2*a;*

Figure 2F:
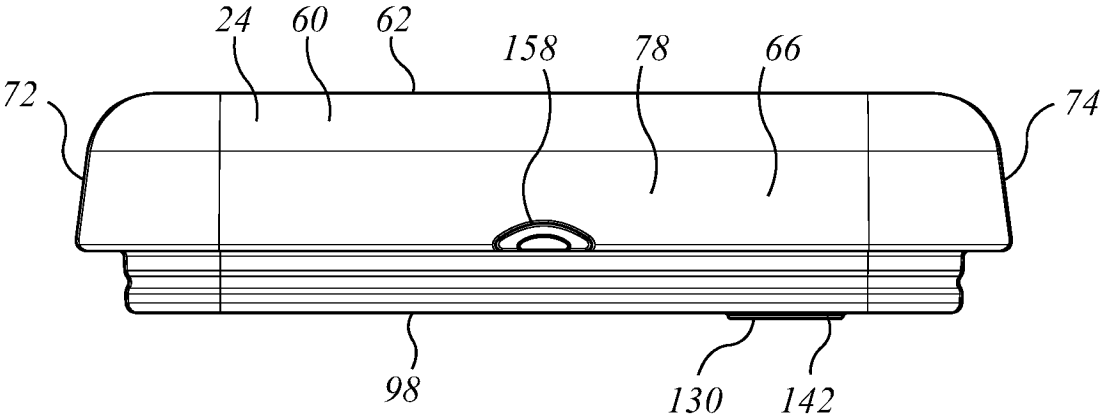

FIG. 2*f* is a left-hand side view of the container lid assembly of FIG. 2*a;*

Figure 2G:
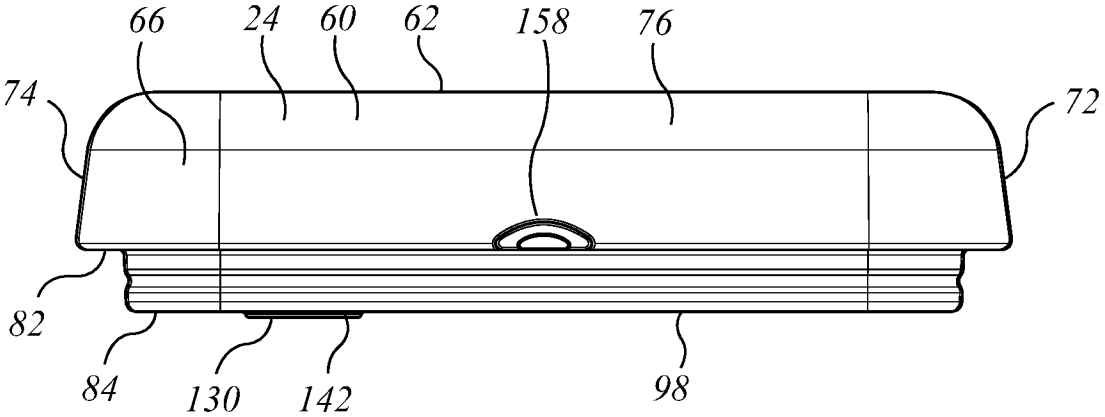

FIG. 2*g* is a right-hand side view of the container lid assembly of FIG. 2*a;*

Figure 3A:
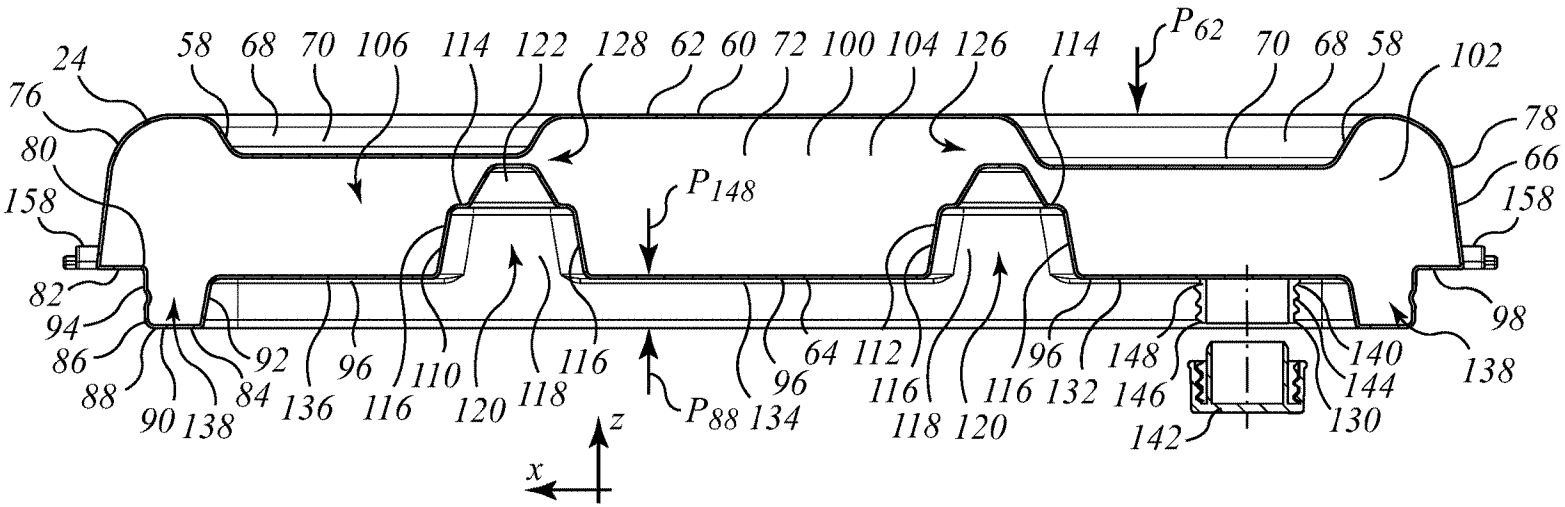
Figure 3B:
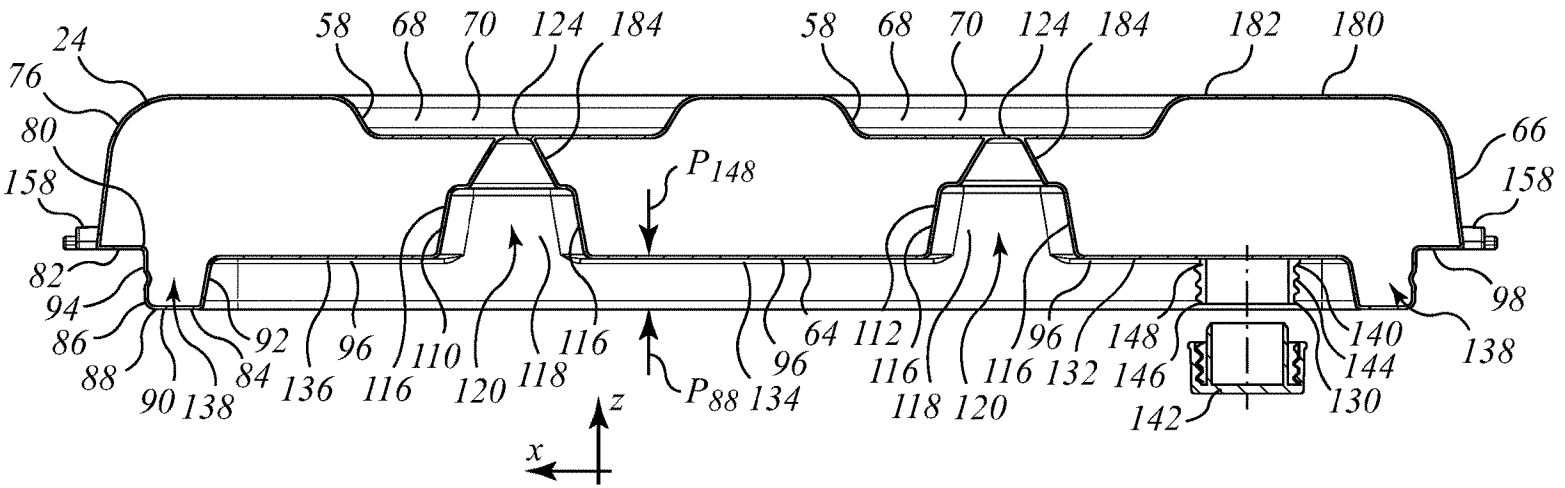

FIG. 3*a* is a lengthwise section of the lid of FIG. 2*c* on staggered section '3*a*-3*a'*;

FIG. 3*b* is a lengthwise cross-section of an alternate lid to that of FIG. 3*a;*

Figure 3C:
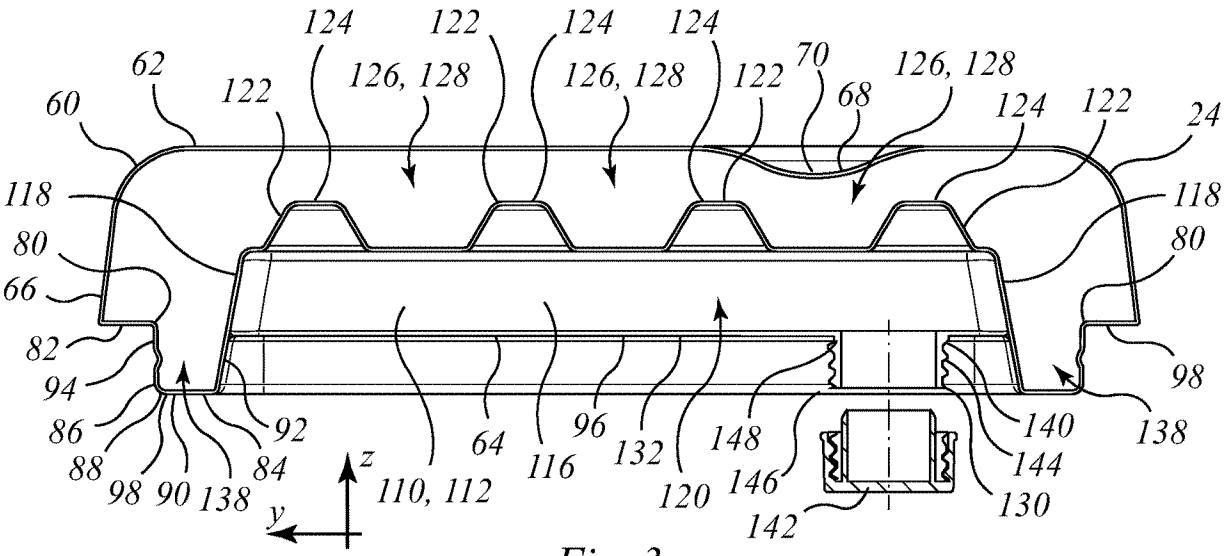
Figure 3D:
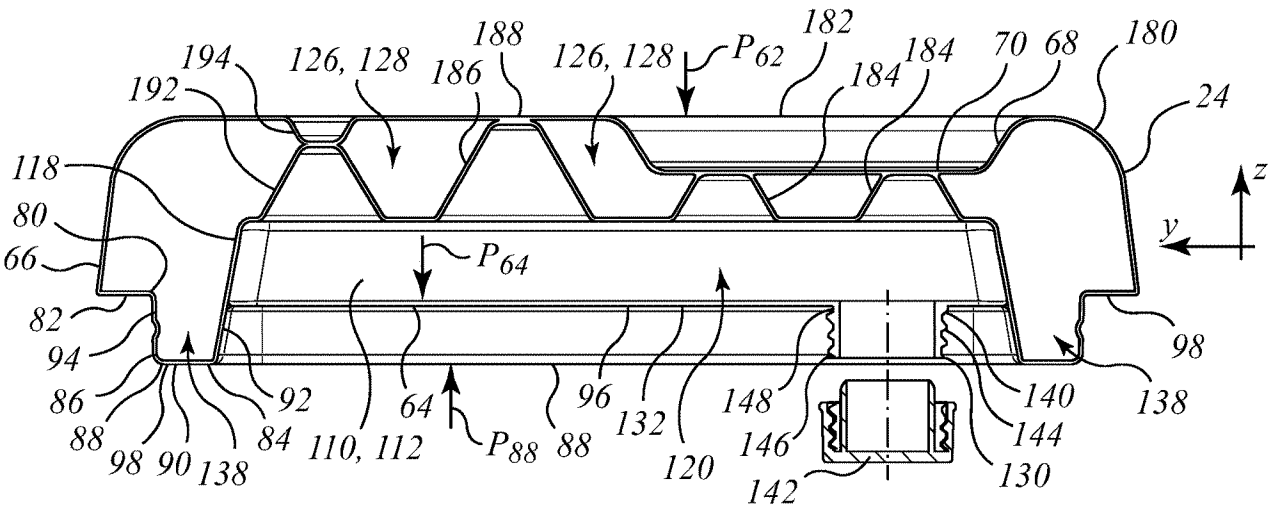

FIG. 3*c* is a front-to-back section of the lid of FIG. 2*c* taken on section '3*c*-3*c'*;

FIG. 3*d* is a front-to-back section of an alternate lid to that of FIG. 3*c;*

FIG. 3*e* is a lengthwise cross-section of another alternate lid to that of FIG. 3*a;*

FIG. 3*f* is a perspective view of an internal baffle of the lid of FIG. 3*e;*

FIG. 3*g* is a perspective view of another internal baffle of the lid of FIG. 3*e;*

FIG. 3*h* is an alternate internal baffle to that of FIG. 3*f;*

FIG. 3*i* is an alternate baffle to that of FIG. 3*g;*

Figure 4A:
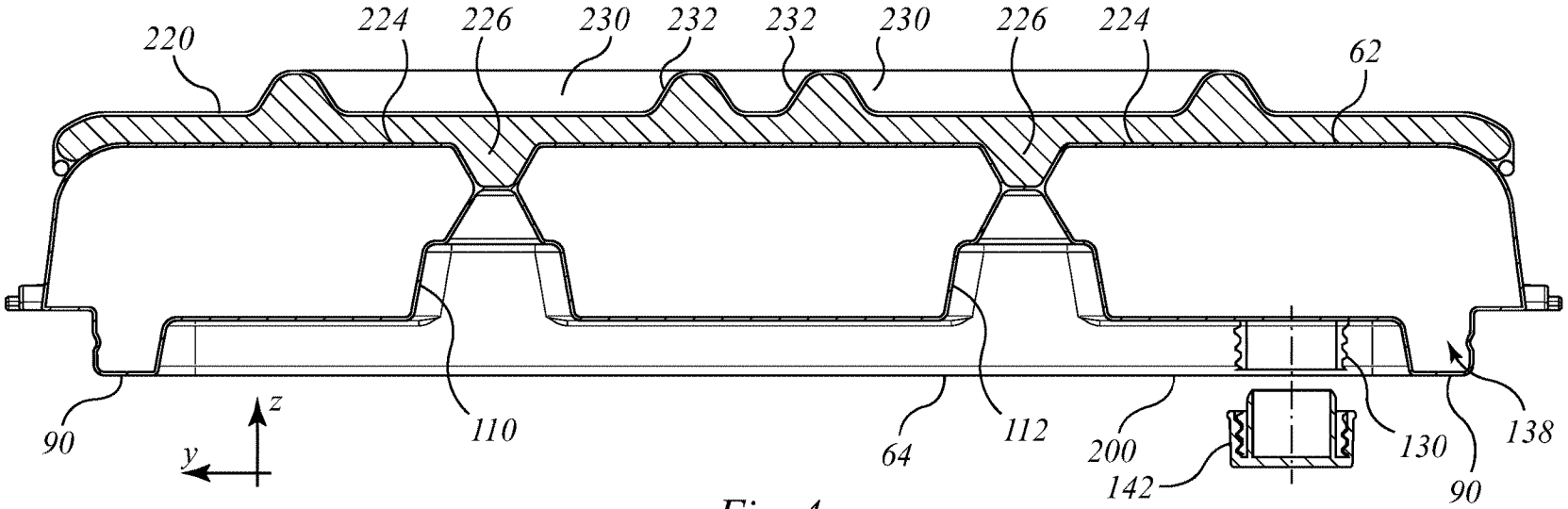
Figure 4B:
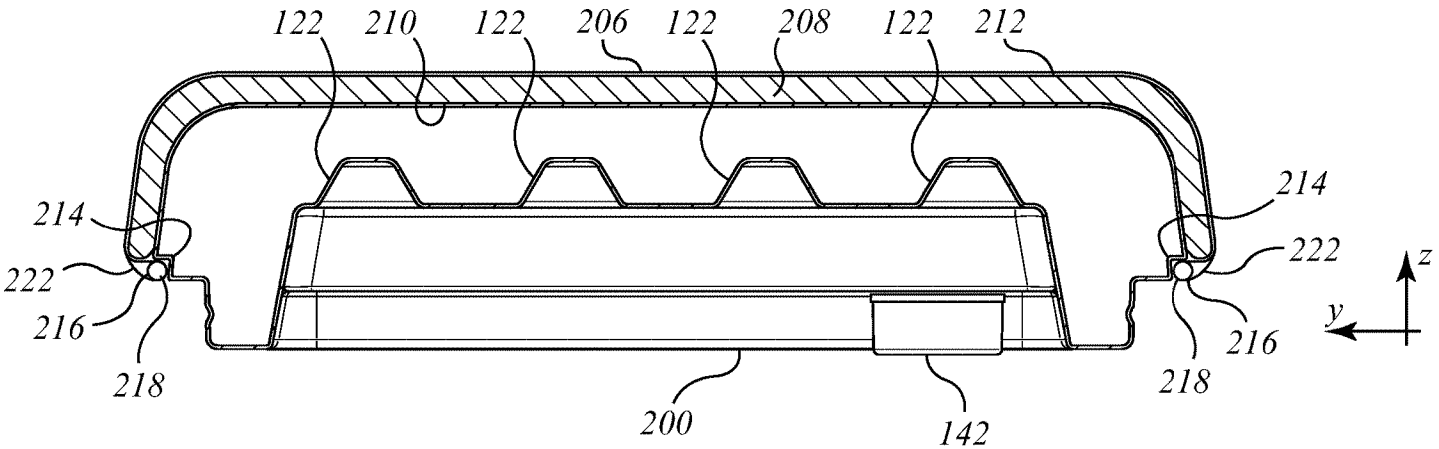
Figure 5:
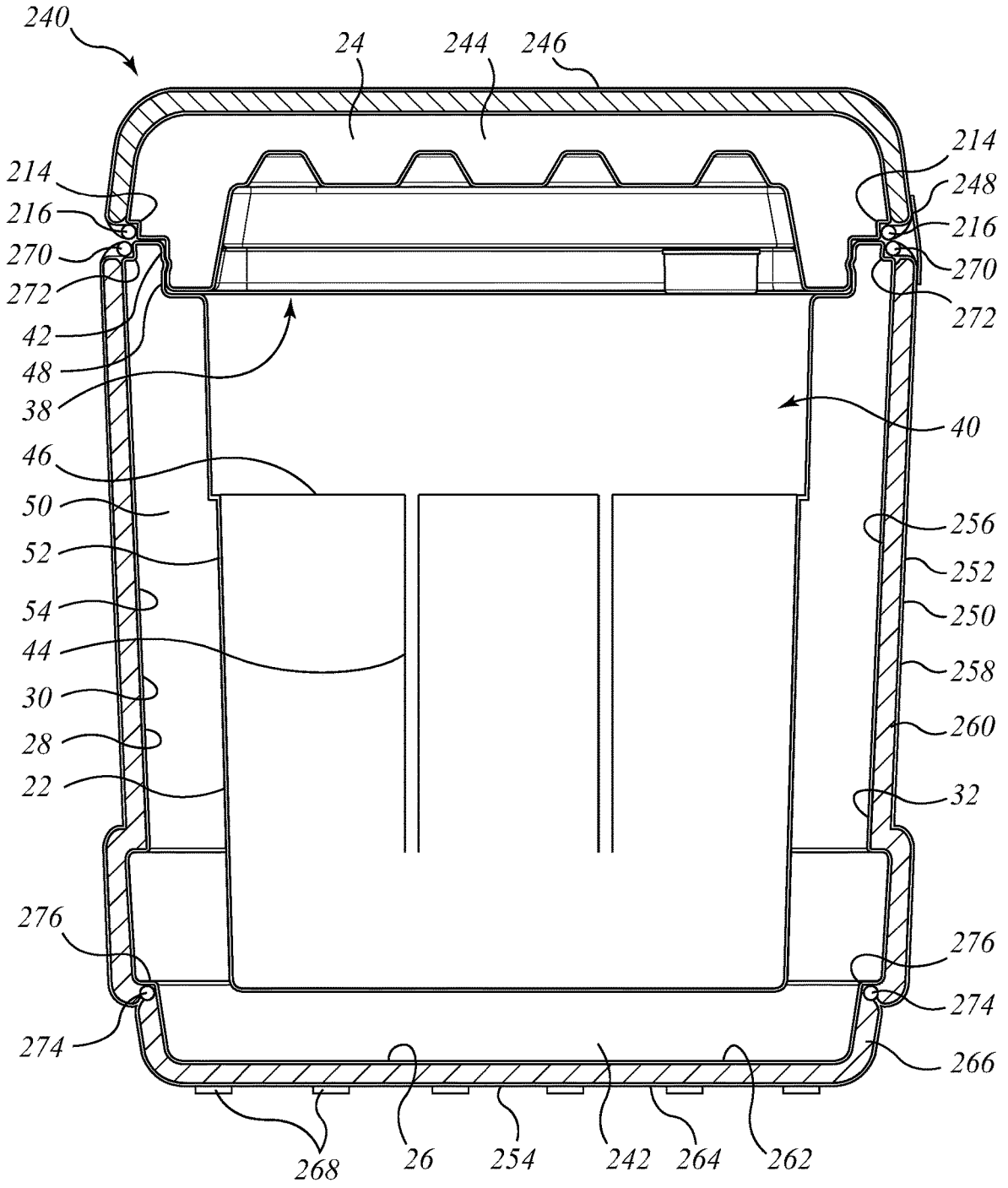

FIG. 4*a* is a front-to back section of an alternate to the lid of FIG. 2*a* provided with an insulated external cover;

FIG. 4*b* is a lengthwise section of an alternate lid to that of FIG. 4*a* in which the external insulation cover has raised retainers formed therein; and FIG. 5 is a cross-section of a container assembly such as that of FIG. 1*a* provided with an insulated cover for the lid and an insulated jacket for the container body.

DETAILED DESCRIPTION

The description that follows, and the embodiments described therein, are provided by way of illustration of an example, or examples, of particular embodiments of the principles of the present invention. These examples are provided for the purposes of explanation, and not of limitation, of those principles and of the invention. In the description, like parts are marked throughout the specification and the drawings with the same respective reference numerals. The drawings are substantially to scale, except where noted otherwise, such as in those instances in which proportions may have been exaggerated to depict certain features of the invention. Notably, the wall thicknesses of molded parts shown in cross-section have been exaggerated to make them more readily visible to the reader.

In this specification reference is made to insulated containers. It should be understood that, within the normal range of temperatures to which human food and human touch is accustomed, although the term "cooler", or "cooler container", or "cooler assembly" may be used, such insulated structures may generally also be used to aid in keeping food, beverages, or other objects either warm or hot as well as cool, cold, or frozen. The adjective "insulated" is intended to be given its usual and normal meaning as understood by persons skilled in the art. It is not intended to encompass single layers, or skins, of conventional webbing materials, such as Nylon (t.m.), woven polyester, canvas, cotton, burlap, leather, paper and so on, that are not otherwise indicated as having, or being relied upon to have, particular properties as effective thermal insulators other than in the context of being provided with heat transfer resistant materials or features beyond that of the ordinary sheet materials in and of themselves. Following from Phillips v. AWH Corp., this definition provided herein is intended to supplant any dictionary definition, and to prevent interpretation in the US Patent Office (or any other Patent Office) that strays from the customary and ordinary meaning of the term "insulated". The Applicant also explicitly excludes cellophane, waxed paper, tin foil, paper, or other single use disposable (i.e., not intended to be re-used) materials from the definition of "washable".

Similarly, this description may use multiple nouns when providing nomenclature for the features annotated in the drawings. The multiple nouns are used as synonyms, and the detailed description is used as a thesaurus to convey understanding at both the specific level and at the broader conceptual level. English often has many terms for the same item, and where multiple terminology is provided, the description is showing that any synonym for the item is to be included in the understanding of the feature, and that it is not limited to one particular noun. FIGS. 1*a*-1*f*, show a container assembly generally as 20. Container assembly 20 has a first portion 22, and a second portion 24. The first portion and the second portion are mutually engageable. The first portion may be thought of, and may also be termed, the container body 22 of the container assembly 20, be it large or small. The second portion is a closure that mates with container body 22. The second portion may likewise be termed, and throughout this specification is termed, the lid 24 for the body of the container defined by first portion 22. Lid 24, i.e., the second portion, is movable between a closed position and an open position relative to container body 22. Lid 24 may be, and in the examples illustrated is, removable, and re-usable. In terms of general construction, both container body 22 and lid 24 may be, and as illustrated are, made of blow-molded plastic. A suitable polymer feed stock may be used for this purpose. Container body 22 and lid 24 may be understood to be rigid. One, the other, or both of them may be, and in the examples herein are, hollow.

When container assembly 20 sits at rest on a surface such as a table or counter-top, or in a vehicle, the first portion is the lower or bottom, or base portion of container assembly 20; and the second portion, being lid 24, is the upper or top portion. The terms "upper" and "lower" are determined by the direction of gravity when container assembly 20 stands predominantly upright (i.e., it may not always be placed on a precisely flat, level, horizontal surface). That is, lid 22 is above body 24 when container assembly 20 is closed. However, by its nature, container assembly 20 may be inverted to some extent when emptied or washed, and it may be dropped, or carried in a bag or other container in which it is not necessarily always upright. In that sense, the designation "upper" or "lower" or "top" or "bottom" is to some extent arbitrary.

In general, first portion 22 may also be referred to as the body of container assembly 20, and may also be termed a vessel, can, canister, jug, stein, mug, base, container, glass, vase, canteen, tumbler, reservoir, cup and so on. Many different terms could be used. Usually, when container assembly 20 is sitting at rest on a surface such as a table or counter-top, first portion 22 is the lower or bottom, or base portion of container assembly 20, and second portion 24 is the upper or top portion. Similarly, a variety of names that may be used for second portion 24. It may be termed a closure, a closure member, a closure assembly, a cap, a lid, a cover, or a top. There are many possible terms that could be used as nomenclature for an object or assembly that mates with, and provides a covering for, the vessel. From this point, first portion 22 will be referred to as the body; and, similarly, second portion 24 will be referred to as the lid.

Container assembly 20 may be, and in the example in the Figures is shown as being, a cooler that has a six-sided box shape form. Each of the various sides is generally rectangular, although the upstanding sides may be gently tapered to facilitate molding, for example. The body, 22, defines a five-sided open-topped box. The space inside the five-sided box is identified as an internal chamber 40 into which objects that the user desires to keep cool or warm (as may be) are placed. The lid 24 defines the sixth side of the box. Lid 24 is movable between open and closed positions to govern access to chamber 40. The five panels or walls of body 22 may be identified as bottom wall 26, and an upstanding peripheral sidewall 28 that stands upwardly and away from bottom wall 26. Peripheral sidewall 28 includes first, second, third, and fourth portions identified as front wall 30, rear wall 32, left-hand side wall 34 and right-hand side wall 36 the opening of chamber 40 is identified as 38; and, as understood, lid 24 covers, or uncovers, opening 38 when it is closed or opened as may be, thereby governing access to chamber 40. Clearly, upstanding peripheral sidewall 28 could have more than four sides, or it could have a continuous curved wall, whether circular, oval, elliptical, or some other shape, as may be. For convenience of description, the example will be referred to as having generally rectangular sides.

The generally rectangular-sided box is conveniently described in a Cartesian frame of reference, or geometric context, for container assembly 20 more generally. That is, the examples of main body 22 and lid 24 herein have the common feature of an upward or vertical direction, or z-axis, which is nominally vertical when container assembly 20 stands on a horizontal surface, and which is measured upwardly from the first end, or bottom, or base, or bottom wall 26 of main body 22, however it may be called. Main body 22 has a width across front wall 30 that defines the x-axis or x-direction. Body 22, and therefore container assembly 20 more generally, has a depth measured in the front-to-back direction that defines the y-axis or y-direction. The upper margins of side walls 30, 32, 34 and 36 co-operate to define a land or rim 42 with which lid 24 engages. As can be seen, the portions of the rim of the various upstanding the sides may have an intermediate groove or set of grooves 44 that run horizontally and peripherally to provide a shoulder upon which to mount internal dividers or shelves, as may be. Such a horizontal shelf may be a horizontally extending web with a peripheral flange that sits on the shoulder. Similarly rim 42 may include downwardly inset shoulder 46 and an upwardly extending sidewall 48 that terminates at the uppermost margin, or lip, of rim 28 of main body 22 most distant from bottom wall 26. It may be noted that the corresponding vertical faces of the closures of lid 24 and body 22 may have, and as illustrated do have, a groove in one and a protruding detent in the other such that when the two mate they are forced into contact and must deflect in an interference fit. This interference fit discourages accidental opening of the lid, and aids in keeping the closure sealed or snug when it is closed. The juncture of bottom wall 26 and sidewall 28 is formed to contain liquids, whether they are separate parts that are joined together, or made from a single part that is molded or extruded as a one-piece unit.

Main body 22 is hollow, and defines internal chamber 40 in which liquid is contained. The walls of main body 22 are themselves hollow, each having a respective inside wall 52, and outside wall 54, and a space or cavity 50 therebetween. In some embodiments, cavity 50 may be filled with insulating material, such as foam insulation.

Lid assembly 24 has a lid body 60. Lid body 60 has an outside wall 62, and inside wall 64, and a peripheral wall 66 that extends about the respective peripheral edges of, and joins, outside wall 62 and inside wall 64. Peripheral wall 66 includes first, second, third, and fourth portions that form the edges, or edge walls of peripheral wall 66 and that are identified as a front wall, rear wall, left hand wall, and right hand wall 72, 74, 76, 78. Outside wall 62 and inside wall 64 are spanning members that span lid 24 from front to rear walls 72, 74 and from left-hand to right-hand walls 76, 78, such that, when lid 24 is mounted to body 22, lid body 60 extends across and covers, or substantially covers, opening 38. By spanning opening 38, and thereby obstructing it, lid 24 serves to retain the contents of chamber 40. As indicated, the corners of lid 24 may be radiused, as shown, to match the radius of container body 22. An internal reservoir or internal chamber 100, is defined within lid 24 and is bounded by inside wall 64, outside wall 62 and peripheral wall 66. One or more external formations 68 may be formed in outside wall 62. External formations 68 can be formed to protrude outwardly from (i.e., stand proud of) the general contour of outside wall 62, or to intrude into (i.e., be shy of) that contour, or both. In the example illustrated, external formation 68 are be sunken into outside wall 62 to form a well 70. Well 70 may be of any shape in plan form, but is typically either rectangular or round, and may most often be circular. The well so formed defines a retainer to keep objects from sliding when place on top of lid 24. Well 70 may also be referred to as a "drink pocket", since diameter of the well is sized to accommodate the base of a drink can, with room to spare. The deformed sidewall 58 of well 70 functions as a stiffening flange relative to the larger unsupported span of outside wall 62 more generally. Similarly, as seen in FIG. 2*c*, outside wall 62 may also have a rectangular depression that has the appearance of a name-plate, and which may be embossed with a commercial branding mark of some kind. This out-of-plane rectangular deformation also functions as a stiffener of the unsupported span.

The edge defined by peripheral wall 66 of lid 24 may have, and as shown does have, a rabbet or groove 80. The rabbet has an inwardly extending wall identified as a land 82 that runs around the outside and has a width and footprint sized to seat on the upper edge of the rim of container body 20. In some instances land 82 may have a gasket. Inwardly of land 82, lid 24 has a formed section 84, that extends around inside wall 64 in the manner of a border, or frame (e.g., in the sense of a picture frame). Formed section 84 may be of a variety of shapes when seen in cross-section. It could have the form of a rounded profile rib or hemisphere, for example. In the example shown, formed section 84 has the form of a channel 86 having and back 88 an inner leg 92, and an outer leg 94. Inner leg 92 merges with the main flat portion 96 of inside wall 64 at a radiused corner. Outer leg 94 merges with the inner margin, or root, of land 82. Outer leg 94 is formed to have a mating profile to engage the vertical leg of rim 42 of peripheral upstanding sidewall 28, being formed with one of the other of a groove or a protruding detent, as noted above. In the example illustrated, lid 24 have the protruding ridge that defines the detent, and body 22 has the groove. It is arbitrary which part has the groove, and which part has the protrusion. Although legs 92 and 94 are shown generally parallel, they may be splayed with a draft angle to facilitate removal from the mold after manufacture. The combined effect of land 82, outer leg 94, back 88, inner leg 92 and the adjacent influenced region of flat portion 96 is to function as a stiffening flange around the outside edge of inside wall 64 more generally. This structure may be termed a flange in one context, but can also be called a channel section or a hat section 90. It is not necessary that land 82 and flat portion 96 be co-planar. However, it is convenient that they be co-planar. Relative to the plane of inside wall 64 (or, alternatively, relative to any horizontal datum of lid 24, such as a mid-depth plane, or the plane of land 82, the stiffener defined by the flange, channel or hat section 90 is formed to protrude inwardly in the z-direction relative to chamber 40, in the sense of protruding downwardly toward the base of container body 22 when lid 24 is mounted in the closed position on container body 22.

It may be noted that "flat portion 96" need not be "flat" in the sense of precisely horizontal or precisely planar, but is seen as being flat in the context of meeting inner leg 92 at an angle such that flat portion 96 functions as a flange relative to the out-of-plane shear web defined by inner leg 92. This function can be performed even if flat portion 96 is neither precisely horizontal nor precisely planar. It will serve if it is predominantly cross-wise to inner leg 92, and if it extends generally span-wise either front-to-back-or left-to-right. Inside wall 64 need not define a monolithic horizontal flat web. As discussed below, inside wall 64 may have internal formations. Moreover, inside wall 64 could be formed on a continuous curvature, or set of curvatures to define a continuous are, or a set of lobes, a set of undulations, and so on. In this context, the actual contour of the internal wall, namely inside wall 64, whatever it may be, defines a liquid-containing barrier, or membrane that defines the lower boundary or inside boundary of chamber 100. Similarly, the same commentary may apply to outside wall 62, whatever its actual shape, contour or profile may be, whether or not planar or arcuate, whether or not precisely horizontal, be it arcuate or wavy or otherwise, defines the upper boundary, or outside boundary of chamber 100 when lid 24 is installed on container body 22. In this explanation the "flat portion" has a continuous surface that has slope continuity. In the case of the "flat portions" the continuous surface may extend in both front-to-back (i.e., y-direction) and side-to side (i.e., x-direction) and so may be a surface of compound curvature. It is distinguished from a stiffener formation, for example, where there is a slope discontinuity. Internal formations 110 and 112 discussed below, and external formation 68, being large scale departures from the contour of the adjacent spanning web portions 132, 134 and 136, define such slope discontinuities, notwithstanding that their transitions are locally radiused. Of course, if lid 24 is lying on its back, upper and lower are reversed, and if lid 24 is standing on one end for filling, then they are sides, not upper and lower. In the more general sense, outside wall 62 and inside wall 64 define spaced-apart, span-wise extending, opposed boundaries, or boundary surfaces, of chamber 100. They extend span-wise in both the front-to-rear context and in the left-to-right context. Peripheral wall 66 also defines a boundary surface of chamber 100, with the various pairs of front and rear walls 72, 74 and left-hand and right-hand walls 76, 78 being mutually opposed and spaced apart from each other and forming the front, rear, left-hand and right-hand sectors of that boundary extending in the through-thickness direction of lid 24.

In that context, too, flange, or channel, or hat section 90, however it may be called, defines a peripherally extending stiffener bounding inside wall 64 peripherally, but also contributing to the lower or inside boundary of chamber 100 defined by inside wall 64 in terms of containing liquid. It provides stiffness against bending both side-to side in the x-direction and front to back in the y-direction. In addition, inside wall 64 has additional stiffening in the form of first and second formations 110 and 112. Although these formations need not be the same, and need not be located symmetrically relative to the lid centerline, whether in the x-direction or the y-direction, nonetheless it is convenient that they be the same (or the same but of opposite hand) and that they be spaced apart from each other symmetrically relative to the front-to-back vertical plane of lid 24. In this instance, whereas the stiffening of the peripheral flange is inward, first and second formations 110 and 112 are formed outwardly in the z-direction, i.e., away from the base of container body 22 when lid 24 is in the closed position.

Formations 110 and 112 have the form of a trench, or channel, running fore-and-aft across the inside of the lid. With lid 24 lying upside down on the ground, formations 110, 112 have a back 114; a pair of long sides 116; and a pair of end walls 118. The side walls merge into the end walls at radiused corners. Since side walls 116 and end walls 118 are sunken at an angle into inside wall 64, the radiused corners are conical. Formations 110, 112 then form an elongate, generally rectangular pyramidal well 120. At the well bottom, i.e., at its distal extremity farthest from the main plane of the flat region of inside wall 64, back 114 has a further set of sockets, or protrusions, identified as dimples 122. Dimples 122 are truncated circular conical sections.

FIGS. 3*b* and 3*d* are intended to illustrate an alternate embodiment, or embodiments, in which there is a lid 180 that may generally be the same as lid 24, unless otherwise noted. It differs, however, in that it has dimples 184 of its respective formations 110, 112 that have narrowed tips 128. Tips 128 of the section merge with the inside of outside wall 182. Is this example, wells 178 have been relocated to lie more centrally over dimples 184 as seen in FIG. 3*b*, such that two dimples 184 merge with each well 70. Whether part of the same embodiment or a different embodiment, where the lid has no drink pocket wells 70, or where those wells do not overlie the dimples, there may be larger, more extended depth dimples 186 that have narrowed tips that merge into the outer skin of outside wall 182, as at 188; or, alternatively there may be an arrangement of one or more internal dimples 190 that co-operate with external dimples 192 to yield a structural linkage between inside wall 64 and outside wall 182. The linking of the inside and outside walls 64, 182 may tend to make lid 180 stiffer, and may tend to reduce deflection of outside wall 182 during freezing cycles. That is, at the locations of dimples 184, 186, 190, 192 inside wall 64 and outside wall 182 are joined together in the molded part. The effect of joining the inner and outer walls together is that they mutually stiffen each other, and share the benefit of the stiffening of the channel sections defined by formations 110 and 112.

With or without interconnection of the inner and outer walls, formations 110, 112 also act as dividers or partitions that sub-divide internal chamber 100 into sub-volumes or regions 102, 104, 106. They would do so even if dimples 122, 184, 186, 190 or 192 were not present. With the presence of dimples the "neck" 126, 128 is even more constricted, and, where inside and outside walls 62 and 64 are connected by the dimple structure, the "neck" is then divided into a plurality of sectors, analogous to a perforated strip. Formations 110, 112 likewise divide the flat portion 96 of inside wall 64 into three parts or regions 132, 134 and 136. Region 132 extends between, and is bounded by, an end portion 98 and the ends of two long portions 108 of hat section 90, and first formation 110. Region 134 is the central region or portion bounded on two ends by the central portions of long side portions 108 of peripheral flange or hat section 90, and on its two sides by formations 110, 112 (i.e., itis between formations 110 and 112). Region 136 extends between, and is bounded by, the other end portion 98 and the ends of two long portions 108 of hat section 90, and second formation 112. Accordingly, each of the webs defined by regions 132, 134 and 136 of flat portion 96 is stiffened along all of its four sides or margins. Whether it is a side portion 108 or an end portion 98, the peripheral formation is a slope discontinuity that defines a boundary condition along the edge of the flat portion, the boundary condition being that of a hinge of little or no out-of-plane displacement but also no bending moment transmission. It is therefore functionally equivalent to a hinged edge. Similarly, the junction with either of formations 110 or 112 is also a slope discontinuity, and also defines a boundary of little or no out-of-plane deflection, and no bending moment transmission. Each of portions or parts or regions 132, 134 and 136 may therefore be conceptualized as a membrane with four hinged edges for the purposes of structural analysis. Moreover, apart from the stiffening achieved, dividing the chamber into sub-volumes in this way may tend to prevent all of the ice from sliding to one end as melting occurs, and may tend to keep it distributed such that there is some ice associated with each sub-volume for a longer time.

Inside wall 64 also has a filler port 130. Filler port 130 includes a filler pipe 144 that has the form of a nipple, or stub, 140, that is rooted to first region 132 of inside wall 64. Filler pipe 144 has a first end, or outer end 146 and a second end, or inner end, 148. Stub 140 mates with filler cap 142. It may be, and in the example shown it is, that stub 140 and filler cap 142 are both threaded, and their threads mate together. Stub 140 may be either internally threaded or externally threaded. In the example shown stub 140 is externally threaded (i.e., is the male engagement interface), and filler cap 142 is internally threaded (i.e., is the female engagement interface). Filler cap 142 may also have, and as shown does have, a seal that is compressed as filler cap 142 is tightened.

When lid 24 lies on its back, the open end, i.e., outer end 146, of stub 140 is uppermost. That end lies flush with, or as illustrated, shy of, the extremity of formed section 84 defined by back 88 of channel 86. Termination of filler pipe 144 shy of the end of the formed section may tend to protect filler pipe 144 from inadvertent damage in use. The root end, i.e., inner end 148, of stub 140 lies flush with the contour of flat region or flat portion 96, however it may be, at the location of that junction. Thus the terminus of the inlet (i.e., in flat portion or flat region 96) lies at an intermediate level between the plane of the flange back 88 and the outside wall 62 of lid 24. That is, it lies intermediate the upper and lower, or outside and inside boundaries of chamber 100 defined by walls 62 and 64. A practical result of this arrangement is that when the ice inside the reservoir defined by chamber 100 of lid 24 begins to melt, if the lid is closed, the water will want to collect in the lowest point which is, initially, the inside of peripheral hat section 90. Conversely, if lid 24 is lying on its back, the water may tend first to collect next to outside wall 62. In addition, the presence of formations 110, 112 and the various dimples, such as dimples 122, may tend to discourage, or delay, the tendency of loose pieces of ice to form, and to slosh about, inside lid 24, but rather to encourage the ice to remain distributed in the lid for longer. In addition, the presence of formations 110 and 112 tends to resist deformation of lid 24 on freezing, such as may cause land 82 to retain its planar condition.

Filler port 130 need not be, and in the example illustrated is not, symmetrically located. Rather it is off-set from the centerline in both the x and y directions. As described above, the entry of filler port 130 into chamber 100 at inner end 148 is intermediate (a) the inner boundary of chamber 100 (and, in particular, that portion of the inner boundary defined by channel section 86) of inside wall 64; and (b) the outer boundary of chamber 100 defined by outside wall 62. Similarly, in every direction in the x-y plane, inner end 148 is inset from peripheral sidewall 66, and therefore it lies intermediate both the front-and-rear boundaries of chamber 100 and the left and right hand boundaries of chamber 100. Thus, when chamber 100 is being filled, it may tend to be filled toward one corner. However, given that port 130 is on the inwardly facing side of lid 24, given that it is not fully at the extremity of chamber 100, and given that the flange defined by formed section 84 is hollow, in the usual course or filling from a tap of water, the user may tend not entirely to fill the full internal volume of chamber 100. Rather a portion of that volume may continue to contain air. If lid 24 is placed in the freezer on its back, the air will collect in the hollow volume 138 inside formed section 84. If lid 24 is place in the freezer right-side-up, then the air will collect against outside wall 62. As the water freezes, it will expand and compress the air. Were there no air in lid 24, the expansion on freezing of the water would tend to want to deform the shape of lid 24, perhaps to an unwanted extent. Lid 24 may have, and in the embodiment illustrated does have a "Fill Line" 150. In the embodiment illustrated fill line 150 is molded into lid 24. Lid 24 may have, and in the example illustrated does have, a "Do Not Over Fill" instruction 152 (i.e., as part of the overall instruction: "Fill to this line. Do not over fill. Remplir a la ligne. Ne pas trop remplir. Llena hasta esta linea. No llena demasiado.") also molded into lid 24 immediately adjacent to fill line 150. In the example illustrated, fill line 150 is flush with the bottom edge of filler port 130 when lid 24 is held upright, or predominantly upright with its long axis (i.e., its nominal x-axis) 154 lying in a vertical plane.

The rim of container body 22 has at its ends on the vertical y-direction plane a pair of half spindles, or half stub-axles 156. Lid 24 has a corresponding pair of half spindles or half stub-axles 158. Container body 22 also includes a carrying handle 160. Carrying handle 160 may be, and in the example illustrated is, a molded hard-plastic part that has a bail 162 having a pair of arms 164 and a spanning portion 166 by which handle 160 is lifted. The roots of bails 162 are pivotally mounted to half stub axles 156. When handle 160 is rotated either to the lifting position or to lie forwardly of container body 22, rotating root fittings 168 rotate forward to capture the upper lid axle halves 158, and thereby defining a movable lock by which to secure lid 24 in its closed position relative to container body 22. Lid 24 also has hand-holds or grips 170 molded into the central portion of its long sides to facilitate removal.

FIGS. 3*e*, 3*f* and 3*g* are intended to illustrate that internal stiffening can be obtained, alternatively, with internal frames or gussets that inter-link the inside wall and the outside wall of the lid. In this example, lid 172 can be taken as being the same as lid 24, or any other lid describes so far, except that rather than having outside wall 62 and inside wall 64, lid 172 has outside wall 174 and inside wall 176. Rather than being joined by a combination of inside formations 110, 112, and dimples, such as may be, lid 172 may have internal frames or gussets 194, 196, 198 that extend between, and join the inside and outside walls. Once again, this has the effect of dividing the reservoir into zones, in this case four zones rather than three zones. Fluid can flow between the four zones through openings 202, 204 in gussets 194, 196, 198. As may be noted, gussets 196 and 198 may be the same, and may be shorter in vertical height in the region of external formation 68 than is gussets 194. Moreover, in a further alternate, a vertically truncated version of internal formation 110, 112 can be used with vertically shorter versions of gussets 194, 196, 198, as may be, in place of the various dimples of the other examples. The use of smaller formations 110, 112 and gussets may tend somewhat to increase the volume of ice that may be contained in the reservoir.

The example of FIGS. 3*h* and 3*i* is intended to illustrate that the baffles of gussets 194, 196, 198 could be replaced by baffle or gusset 234 in the case of gusset 194, or gusset 236 in the case of baffle or gusset 196, 198. The profile of gussets 194, 196 and 198 could be altered to fill the entire section of the lid around its entire periphery, including extensions to seat in the hollow of channel 86. Were that the case, the gusset could have relieved or clipped corners 228 as seen in the case of gusset 234, to facilitate draining of the reservoir. The reliefs defined by clipped corners 228 leave an opening to permit melt water to drain past gusset 234. Similarly, or alternatively, gusset 196, 198 could have an additional relief 238 (or more than one) along the opposite side of gusset 236 as shown. Clearly, any of gussets 194, 196, 198 could have any combination of openings, clipped corners 228 or additional edge reliefs 238 as may be.

In the example of FIGS. 2*a*-2*h* lid 24 is separable from container body 22 so lid 24 can be placed in the freezer by itself. In the example of FIGS. 4*a*-4*b*, lid 200 for use with container body 22 is substantially the same as lid 24. In some embodiments, it could be lid 24. It differs from the depiction of lid 24 in FIG. 1*c*, for example, in having an insulated cover 206. Insulated cover 226 has a layer of thermal insulation 208. Thermal insulation 208 may have an inner skin 210 and an outer skin 212. Inner skin 210 may be a reflective skin having a shinny metallic surface. Outer skin 212 may be made of, or may include, a relatively heavy, scuff-resistant or wear resistant fabric, such as a woven nylon. Thermal insulation 208 can be mounted permanently to lid 200, as, for example, with an adhesive. Alternatively, as shown, insulated cover 206 may be removable, i.e., separable, from lid 200, such that it can be removed when lid 200 is placed in the freezer. To that end, the edges of lid 200 are provided with retention fittings, in the form of inset reliefs, or seats, or an accommodation 214. These seats or accommodations 214 may run around the entire periphery of lid 200, or may be formed only at the four corners, or in such a manner to yield a statically determinate set of catches by which the edge of cover 206 is captured and must be stretched to release. Cover 206 has corresponding engagement fittings or retainer fittings 216. In this example, the retainer fitting or fittings may include, and as shown does include, an elasticized band 218 is sewn into a fabric or web skirt 222 of insulated cover 206. When cover 206 is in place, the elasticized band seats in accommodation 214. When cover 206 is to be removed, elasticized band 218 is stretched to disengage accommodation 214. Cover 206 may be relieved along the short ends of lid 200 to permit passage of arms 164 of handle 160. Insulated cover 206 may be a soft-sided insulated cover, and, rather than being rigid molded plastic, the insulation of insulated cover 206 may be a softer, compressible, "spongy" foam. The external layer may be a fabric covering.

The external surface of cover 206 may be smooth, without external formations, as shown in FIG. 4*b*, in which the exterior surface is relatively flat and is unimpeded by ridges, bumps, depressions, and so on. By contrast, the cover may have internal engagement fittings, external formations, or both. In the example of FIG. 4*a*, cover 220 has an optional internal formation, or formations 224, which might be thought of, or take the form of, a pimple, or a nub, identified as item 226, which is formed in the negative image of the cavity of dimple 192 of lid 180. In an alternate form of internal formation, cover 220 could has a deepened section to occupy a drink pocket well, such as well 70. Engagement of nub 224 in dimple 192 will discourage creeping of cover 220 relative to lid 180 in the x and y directions. Also in the example of FIG. 4*a*, cover 220 has an external formation, or formations, 230, which may be of any suitable shape in plan form view. In the example of FIG. 4*a*, formations 230 identified as circular retainers 232, which may define drink holders, as before. Formations 230 could be sunk into the foam of cover 226 to yield a well that is shy of the rest of the outside surface of cover 226; however, in the example shown they are shown as raised ridges that stand proud of the surrounding surface.

Just as lid 24 or 180 or 200 may have an insulated cap or cover, container body 22 may have an insulated wrapping, or insulated jacket. In the example of FIG. 5, container assembly 240 has a main body 242 and a lid 244. Lid 244 has an insulated cap or cover 246. Main body 242 has an insulated jacket 250. Cover 246 and jacket 250 may be joined by a hinge 248. As may be understood, lid 244 may be the same as, or substantially the same as, any of the lids described above. In each case, whatever style of type of lid it may be, it continues to have the mating interface that permits engagement with main body 242, and opening and closing relative to chamber 40. Similarly, body 242 can be of any style provided that it also retains the mating interface geometry for co-operation with the lid, whichever permutation or combination of the above described examples that may be. Cover 246 may be the same as, or substantially the same as, any of the above-described covers such as may be suitable for co-operation with lid 244.

Jacket 250 has an upstanding peripheral wall 252 which may be considered as a sleeve. The sleeve has a smaller periphery at the bottom than at the top. Optionally, jacket 250 may also have a bottom panel, or base pan, or shoe, 254. Peripheral wall 252 may be a soft-sided insulated wall having an inner layer or inner skin 256, an outer layer or outer skin 258, and insulation 260 between the inner and outer skins 256 and 258. Peripheral wall 252 may be somewhat resilient, i.e., stretchy, to allow it to hug main body 242 in the manner of a sweater. Shoe 254 may also be of the same, soft-sided fabric construction with an inside skin 262, an outside skin 264 and a layer of insulation 266. However, since the weight of container assembly 240 rests on it, and since it may be in contact with the ground, or may be dragged across rough or uneven surfaces, shoe 254 may alternatively be made of a different construction. First outside skin 264 may be made of a thicker, more durable material than outside skin 258, so that it acts as a scuff-resistant protective layer. This skin may be a fabric, and may be a woven high-molecular weight polymer such as a Nylon (t.m.). Alternatively, skin 258 may be a substantially rigid molded part that, again, is capable of functioning as a scuff pad. It may have an array of feet or skids 268.

Jacket 250 has an upper retainer 270. Upper retainer may engage with, and in the example of FIG. 5 does engage with, an accommodation, or set of accommodations 272 formed in the uppermost rim of main body 242. Accommodation 272 may have the form of a groove or rebate formed in that rim, whether around the entire periphery or around such portion of the periphery defines a statically determinate retaining footprint. For example, accommodation 272 may have the form of a set of four such groove located at the four corners of main body 242. Retainer 270 may be resilient, e.g., elasticized, such as to set in, or grasp, accommodation 272 and to resist axial motion of peripheral wall in the downward direction. Conceptually, retainer 270 can be thought of as the waist-band that holds a pair of pants from falling down. Similarly, the bottom margin of the sleeve, i.e., the lower edge of peripheral wall 252, may also have a retainer 274, which engages an accommodation, or set of accommodations, 276 defined by the formed lower rib of main body 242. Retainer 274 may likewise be resilient, or elasticized such that retainer 274 will grip accommodation 276. Retainer 274 thus acts like a waist-band in reverse, to prevent the lower cuff of the sleeve from creeping up the outside wall of main body 242. The sleeve may also additionally, or alternatively, have an upwardly running tracked fastener such as a zipper located in either the back or a side of the jacket to allow it to be zipper up at the back like a dress. Where jacket 250 includes a bottom pan, such as shoe 254, shoe 254 may be attached to, and may share the resiliency of, retainer 274, as shown in FIG. 5.

On installation, main body 242 is slid downward into jacket 250, with retainers 270 and 274 being stretched as this occurs. Where a zipper is used, the zipper is open as this occurs, to allow jacket 250 to flex and stretch more easily. Where removal is desired, if there is a zipper, it is released. Upper retainer 270 is stretched to disengage accommodation 272, and the upper edge is slid partially down the outside wall of main body 242. This permits jacket 250 to be drawn downward and removed.

In the embodiment of FIG. 5, cover 246 and jacket 250 are joined by a hinge 248. Hinge 248 is a flexible hinge. Hinge 248 may be, and as shown is, a flexible fabric hinge. Hinge 248 functions as a lanyard to keep lid 244 attached to main body 242. However, when it is time to re-freeze lid 244, it may be released from cover 246 and placed in a freezer as may be desired. Alternatively, in a different context, container assembly 240 may function as a thermal bottle for retaining heat, and hot or boiling water may be contained in lid 244 in the manner of a hot water bottle to aid in delaying the cooling of objects inside chamber 40.

In summary, in each of the examples there is a cooler lid, be it 24, 180, 200 or 244, as may be. The cooler lid has a hollow body 60, or as may be, having an outside wall 62, an inside wall 64, and a peripheral wall 66 joining the outside wall 62 to the inside wall 64. Outside wall 62, inside wall 64, and peripheral wall 66 define boundaries of an internal chamber 100 of lid 24 (or as may be). Internal chamber 100 has a filler port 130. Filler port 130 is inset from the peripheral wall defined by formed section 84, and, alternatively, by peripheral wall 66. That is, filler port 30 is spaced from, or distant from, the peripheral wall in the front-to-back sense (y-direction). Filler port 130 is also distant from, or spaced from, the peripheral wall in the side-to-side sense (x-direction). It is in the midst of flat portion 132, rather than being formed at the edge thereof. Filler port 130 has an entrance 148 to chamber 100 that is intermediate outside wall 62 and inside wall 64. That is, as shown, outside wall 62 has a dominant location symbolised by plane $P_{62}$ in FIGS. 3*a* and 3*d*. Inside wall 64 (or as may be) has a datum in the "flat portion" symbolised by the contour or surface identified by plane $P_{64}$ in FIG. 3*d* of plane $P_{148}$ in FIGS. 3*a* and 3*b*. Inside wall 64 also has a distant extremity in the sense of the z-direction symbolized by the lower boundary of hollow volume 138, symbolised by the surface or contour identified as plane $P_{88}$ of back 88 of formed section 84. As can be seen, whether inner end 148 lies in a plane or not, to the extent that the entrance to chamber 100 defined by inner end 148 lies flush with the contour of the surface of the "flat portion" 132, it lies intermediate planes $P_{88}$ and $P_{62}$. Accordingly, without regard to orientation of lid 24, a first portion of the volume of chamber 100 lies at a level above the entrance of filler port 130 into chamber 100, and a second portion of the volume of chamber 100 lies at a level below the entrance of filler port 100 into chamber 100. Thus when chamber 100 is being filled, even if it is filled past the "fill to" line 150, there will nonetheless remain a substantial amount of air in the unfilled volume. The locations of the first and second portions of that volume will change depending on the actual orientation of lid 24, just as a bubble moves in the glass of a bubble level according to its orientation.

As described, lid 24 has a "fill-to" line 150 integrally formed therein, and it is visible from filler port 130 so that a person filling lid 24 has the "fill to" line in sight as filling occurs. Cooler lid 24 can be thought of as having a projected volumetric envelope—i.e., the 3-dimensional volume defined by the intersection set of the projections of container lid 24 as projected orthogonally in the x, y, and z-directions.

Filler pipe 144 of filler port 130 is contained within said projected volumetric envelope. As such it may tend to be at least somewhat protected from inadvertent damage. As seen, filler pipe 144 is mounted to inside wall 64 of lid 24 (or 180, 200 or 244, as may be), and, when said lid is placed upside-down, as when lying on its outer wall 62, filler pipe 144 opens predominantly upward. Moreover, inside wall 64 of lid 24 (or 180 etc.) includes a peripheral formed section 84 that is hollow to define a cavity 138 therewithin, said cavity 138 being in fluid communication with chamber 100 more generally, inasmuch as cavity 138 forms a portion thereof. When lid 24 (etc.) is lying upside-down on outside wall 64 (etc), cavity 138 of peripheral formed section 84 is located predominantly upwardly of the entrance end 148 of filler port 130 into chamber 100. As described, inside wall 64 has peripherally extending structural section 84, which includes a hollow channel 86 that is in fluid communication with chamber 100. Channel 86 has a back 88 and a pair of spaced apart legs 92, 94. Inside wall 64 includes a spanning membrane 96 that extends front-to-rear and left-to-right. Channel 86 merges into spanning membrane 96 of inside wall 64. Channel 86 stands away from outside wall 62. When lid 24 is mounted on a mating container body 22, the entrance of inner end 148 of filler port 130 into chamber 100 is higher than hollow channel 86 and lower than outside wall 62. As described at least one of (a) outside wall 62; and (b) inside wall 64, has at least a first out-of-plane formation formed therein. That is, inside wall 62 has out-of-plane formations 110, 112; and outside wall 64 has formations 68 or 194, or both, as may be. Chamber 100 has first, second, and third portions 102, 104, and 106. Neck 126 is formed between portions 102 and 104; neck 128 is formed between portions 104 and 106. Lid 24 (etc.) is rectangular in plan view. Inside wall 64 has at least one span-wise stiffener formed therein, namely the stiffeners defined by internal formations 110, 112 that run spanwise in the front-to-rear direction, although they could run side-to-side in the left-to-right spanwise direction. The spanwise stiffeners so defined are structurally connected to outer wall 64 and to outer peripherally extending formed section 84 thereof at either end. Chamber 100 is divided into first, second and third portions by spanwise extending internal formations 110, 112. As noted above, those portions are linked by respective necks 126, 128. In the embodiments of FIGS. 4*a* and 4*b* cooler lid 24 has an insulated cover 206 that mates with said outside wall 64 (etc.) thereof. In this example, lid 24 (etc.) is removably separable from insulated cover 206.

Looking at lid 24 from a different aspect, as before it has a hollow body having an outside wall, an inside wall, and a peripheral wall joining said outside wall to said inside wall. The inside wall has a land 82 for mating engagement with a corresponding land, namely upwardly facing shoulder 46 a cooler body 22. The outside wall, inside wall, and peripheral wall define boundaries of internal chamber 100 of lid 24. Internal chamber 100 has a filler port 130. Inside wall 64 has a peripheral formation, namely formed section 84. It has land 82 that, in use, engages mating container body 22. Inside wall 62 has at least one stiffener extending one of (a) spanwise in a front-to-rear direction; and (b) spanwise in a left-to-right direction. As above, the stiffeners divide the internal chamber into first, second, and third portions. The first, second, and third portions are joined by respective necks. In that lid, the peripheral formation is hollow and has a cavity 138 formed therewithin. Cavity 138 is joined to, and forms part of internal chamber 100. When lid 24 is sitting on cooler body 22, peripheral formation 84 defines a channel 86 having a back 88 that extends downwardly; and the spanwise formations 110, 112 define channels each having a back 114 that extends upwardly. Each spanwise formation defines a spanwise extending channel having a back 114 and a pair of legs 116. Legs 116 extend downwardly of back 114. Peripheral formation 84 defines a peripheral channel 86 that has a back 88, an inner leg 92 and an outer leg 94. Inner leg 92 and outer leg 94 extend upwardly from back 88. Inside wall 64 has a spanwise extending web 96 that has three portions 132, 134, 136, each of which is bounded by a combination of at least one of spanwise formations 110, 112 and at least one portion 98 or 108 of peripheral formation 84. Inner leg 92 merges with at least one spanwise extending web portion 132, 134, 136 of web 96 and extends downwardly therefrom. At least one of legs 116 of the channel defined by formation 110, 112 merges with a portion 132, 134 or 136 of spanwise extending web 96 and extends upwardly therefrom.

As described inside wall 64 of lid 24 has a first spanwise extending web, namely any one of portions 132, 134, 136 of flat portion 96, and a second spanwise extending web, namely an adjacent other one of portions 132, 134 or 136 of flat portion 196. One of spanwise extending formations 110, 112 is located between, and bounds an edge of each of the first and second spanwise extending webs, or web portions. Peripheral formation 86 bounds at least two other edges of the first spanwise extending web or web portion. Filler port 130 is mounted to the first spanwise extending web, or web portion. In some embodiments, formations 110, 112 are structurally interconnected to outside wall 62 at a location inwardly distant from peripheral formation 86. As seen in FIGS. 3*b* and 3*d*, this may be achieved in a number of ways. Outside wall 62 has at least a first out-of-contour formation 68 formed therein. It defines a drink pocket 70. Spanwise extending formations 110, 112 of inside wall 64 (etc.,) have a locally extending portion, namely dimples 122, 184, 186, 190, 192 connecting it to drink pocket 70 of outside wall 62. Cooler lid 24 has a removable insulated cover 206. Outside wall 62 has a contour. Inside wall 64 has a contour. Spanwise extending formations 62, 64 extend upwardly out-of-contour relative to inside wall 64. Peripheral formation 86 extends downwardly out-of-contour relative to inside wall 64. Filler port 130 is mounted flush with the contour of inside wall 64.

Both cooler body 22 and cooler lid 24 may be made of blow-molded plastic. Either or both of them could alternatively be made of other materials such as fiberglass or metal, although these materials might be formed using a lay up or casting process. Alternate fabrication methods may also be used. Those methods could include the use of a 3-D printing process or other molding process.

Various container body and lid combinations have been shown, or described, or both. The features of the various embodiments may be mixed and matched as may be appropriate without the need for further description of all possible variations, combinations, and permutations of those features.

The principles of the present invention are not limited to these specific examples which are given by way of illustration. It is possible to make other embodiments that employ the principles of the invention and that fall within its spirit and scope of the invention. Since changes in and or additions to the above-described embodiments may be made without departing from the nature, spirit or scope of the invention, the invention is not to be limited to those details, but only by the appended claims.

We claim:

1. A cooler lid, said cooler lid comprising:

a hollow body having an outside wall, an inside wall, and a peripheral wall joining said outside wall to said inside wall;

said outside wall, inside wall, and peripheral wall defining boundaries of an internal chamber of said lid;

said internal chamber of said lid being located between said inside wall and said outside wall and being surrounded by said peripheral wall;

said internal chamber having a filler port;

said filler port being inset from said peripheral wall;

said filler port having an entrance to said chamber that is intermediate said outside wall and said inside wall; and without regard to orientation of said lid, a first portion of volume of said chamber lies at a level above said entrance of said filler port, and a second portion of volume of said chamber lies at a level below said entrance of said filler port;

said inside wall includes a peripheral formed section;

said peripheral formed section being hollow to define a cavity therewithin, said cavity being in fluid communication with said chamber and forming a portion thereof; and, when said lid is lying upside-down on said outside wall, said cavity of said peripheral formed section being located predominantly upwardly of said entrance of said filler port into said chamber.

2. The cooler lid of claim 1 wherein said cooler lid has a "fill-to" line integrally formed therein, said "fill-to" line being visible from said filler port.

3. The cooler lid of claim 1 wherein said cooler lid has a projected volumetric envelope, said filler port includes a filler pipe, and said filler pipe is contained within said projected volumetric envelope.

4. The cooler lid of claim 3 wherein said filler pipe is mounted to said inside wall of said lid, and, when said lid is placed upside-down on its outer wall, said filler pipe opens predominantly upward.

5. The cooler lid of claim 1 wherein said peripheral formed section includes a hollow channel; said channel having a back and a pair of spaced apart legs; said inside wall having a spanning membrane extending front to rear and left to right; said channel merging into said inside wall; said channel standing away from said outside wall; and, when said lid is mounted on a mating container, said entrance of said filler port into said chamber being higher than said hollow channel and lower than said outside wall.

6. The cooler lid of claim 1 wherein at least one of (a) said outside wall; and (b) said inside wall, has at least a first out-of-plane formation formed therein.

7. The cooler lid of claim 1 wherein said chamber has at least a first portion, a second portion, and a neck defined between said first portion and said second portion.

8. The cooler lid of claim 1 wherein said lid is rectangular in plan view, and said inside wall has at least one span-wise stiffener formed therein; said at least one span-wise stiffener extending one of (a) front to rear; and (b) left to right; and said span-wise stiffener being structurally connected to said outer wall; said chamber being divided into at least first and second portions by said at least one span-wise stiffener; and said first and second regions of said chamber being linked by a neck.

9. The cooler lid of claim 1 wherein said lid has an insulated cover that mates with said outside wall thereof.

10. The cooler lid of claim 9 wherein said lid is removably separable from said insulated cover.

11. The cooler lid of claim 1, wherein:

said peripheral formed section has a land that, in use, engages a mating container body;

said inside wall having at least one stiffener extending one of (a) spanwise in a front-to-rear direction; and (b) spanwise in a left-to-right direction; and said at least one stiffener divides said internal chamber into at least a first portion and a second portion, said first portion and said second portion being joined by a neck.

12. The cooler lid of claim 11 wherein said peripheral formed section is hollow and has a cavity formed therewithin, said cavity is joined to, and forms part of said internal chamber; and, when said cooler lid is sitting on the cooler body, said peripheral formed section defines a channel having a back that extends downwardly and said at least one spanwise formation defines a channel having a back that extends upwardly.

13. The cooler lid of claim 11 wherein:

said at least one spanwise formation defines at least one spanwise extending channel having a back and a pair of legs, said legs extending downwardly of said back of said spanwise extending channel;

said peripheral formed section defines a peripheral channel, said peripheral channel having a back, an inner leg and an outer leg, said inner leg and said outer leg extending upwardly from said back of said peripheral channel; and said inner wall having at least one spanwise extending web, said at least one spanwise extending web being bounded by a combination of said at least one spanwise formation and at least one portion of said peripheral formed section;

said inner leg of said peripheral channel merging with said at least one spanwise extending web and extending downwardly therefrom; and at least one of said legs of said channel of said at least one spanwise formation merging with said spanwise extending web and extending upwardly therefrom.

14. The cooler lid of claim 11 wherein:

said inside wall of said lid has at least a first spanwise extending web and a second spanwise extending web;

a first of said spanwise extending stiffeners is located between, and bounds one edge of each of said first spanwise extending web and said second spanwise extending web; said peripheral formed section bounding at least two other edges of said first spanwise extending web; and said filler port is mounted to said first spanwise extending web.

15. The cooler lid of claim 11 wherein said at least one spanwise stiffener is structurally interconnected to said outside wall at a location inwardly distant from said peripheral formed section.

16. The cooler lid of claim 11 wherein said outside wall has at least a first out-of-contour formation formed therein, said first out-of-contour formation defining a drink pocket.

17. The cooler lid of claim 16 wherein said at least one spanwise extending stiffener of said inside wall has a locally extending portion connecting it to said drink pocket of said outside wall.

18. The cooler lid of claim 11 wherein said cooler lid has a removable insulated cover.

19. The cooler lid of claim 11 wherein said outside wall has a contour; said inside wall has a contour, said at least one spanwise extending stiffener extends upwardly out-of-contour relative to said inside wall; said peripheral formed section extends downwardly out-of- contour relative to said inside wall, and said filler port is mounted flush with said contour of said inside wall.

20. A cooler lid, said cooler lid comprising:

a hollow body having an outside wall, an inside wall, and a peripheral wall joining said outside wall to said inside wall; said outside wall, inside wall, and peripheral wall defining boundaries of an internal chamber of said lid;

said internal chamber of said lid being located between said inside wall and said outside wall and being surrounded by said peripheral wall; said internal chamber having a filler port; said filler port being inset from said peripheral wall;

said filler port having an entrance to said chamber that is intermediate said outside wall and said inside wall; and without regard to orientation of said lid, a first portion of volume of said chamber lies at a level above said entrance of said filler port, and a second portion of volume of said chamber lies at a level below said entrance of said filler port;

said structural section including a hollow channel;

said hollow channel being in fluid communication with and being part of said chamber;

said channel having a back and a pair of spaced apart legs;

said inside wall having a spanning membrane extending front to rear and left to right;

said channel merging into said inside wall; said channel standing away from said outside wall; and, when said lid is mounted on a mating container, said entrance of said filler port into said chamber being higher than said hollow channel and lower than said outside wall.

21. A cooler lid, said cooler lid comprising:

a hollow body having an outside wall, an inside wall, and a peripheral wall joining said outside wall to said inside wall; said outside wall, inside wall, and peripheral wall defining boundaries of an internal chamber of said lid;

said internal chamber of said lid being located between said inside wall and said outside wall and being surrounded by said peripheral wall; said internal chamber having a filler port; said filler port being inset from said peripheral wall;

said filler port having an entrance to said chamber that is intermediate said outside wall and said inside wall;

without regard to orientation of said lid, a first portion of volume of said chamber lies at a level above said entrance of said filler port, and a second portion of volume of said chamber lies at a level below said entrance of said filler port;

said inside wall having a peripheral formation, said peripheral formation including a land that, in use, engages a mating container body;

said inside wall having at least one stiffener extending one of (a) spanwise in a front-to-rear direction; and (b) spanwise in a left-to-right direction;

said at least one stiffener divides said internal chamber into at least a first portion and a second portion, said first portion and said second portion being joined by a neck;

said peripheral formation is hollow and has a cavity formed therewithin, said cavity is joined to, and forms part of said internal chamber; and when said cooler lid is sitting on the cooler body, said peripheral formation defines a channel having a back that extends downwardly and said at least one spanwise formation defines a channel having a back that extends upwardly.

22. A cooler lid, said cooler lid comprising:

a hollow body having an outside wall, an inside wall, and a peripheral wall joining said outside wall to said inside wall;

said outside wall, inside wall, and peripheral wall defining boundaries of an internal chamber of said lid; said internal chamber of said lid being located between said inside wall and said outside wall and being surrounded by said peripheral wall;

said internal chamber having a filler port; said filler port being inset from said peripheral wall; said filler port having an entrance to said chamber that is intermediate said outside wall and said inside wall;

without regard to orientation of said lid, a first portion of volume of said chamber lies at a level above said entrance of said filler port, and a second portion of volume of said chamber lies at a level below said entrance of said filler port;

said inside wall having a peripheral formation, said peripheral formation including a land that, in use, engages a mating container body;

said inside wall having at least one stiffener extending one of (a) spanwise in a front-to-rear direction; and (b) spanwise in a left-to-right direction; and said at least one stiffener divides said internal chamber into at least a first portion and a second portion, said first portion and said second portion being joined by a neck said at least one spanwise formation defines at least one spanwise extending channel having a back and a pair of legs, said legs extending downwardly of said back of said spanwise extending channel;

said peripheral formation defines a peripheral channel, said peripheral channel having a back, an inner leg and an outer leg, said inner leg and said outer leg extending upwardly from said back of said peripheral channel;

said inner wall having at least one spanwise extending web, said at least one spanwise extending web being bounded by a combination of said at least one spanwise formation and at least one portion of said peripheral formation;

said inner leg of said peripheral channel merging with said at least one spanwise extending web and extending downwardly therefrom; and at least one of said legs of said channel of said at least one spanwise formation merging with said spanwise extending web and extending upwardly therefrom.

23. A cooler lid, said cooler lid comprising:

a hollow body having an outside wall, an inside wall, and a peripheral wall joining said outside wall to said inside wall;

said outside wall, inside wall, and peripheral wall defining boundaries of an internal chamber of said lid; said internal chamber of said lid being located between said inside wall and said outside wall and being surrounded by said peripheral wall;

said internal chamber having a filler port; said filler port being inset from said peripheral wall; said filler port having an entrance to said chamber that is intermediate said outside wall and said inside wall;

without regard to orientation of said lid, a first portion of volume of said chamber lies at a level above said entrance of said filler port, and a second portion of volume of said chamber lies at a level below said entrance of said filler port;

said inside wall having a peripheral formation, said peripheral formation including a land that, in use, engages a mating container body;

said inside wall having at least one stiffener extending one of (a) spanwise in a front-to-rear direction; and (b) spanwise in a left-to-right direction; and said at least one stiffener divides said internal chamber into at least a first portion and a second portion, said first portion and said second portion being joined by a neck;

said inside wall of said lid has at least a first spanwise extending web and a second spanwise extending web;

a first of said spanwise extending stiffeners is located between, and bounds one edge of each of said first spanwise extending web and said second spanwise extending web; said peripheral formation bounding at least two other edges of said first spanwise extending web; and said filler port is mounted to said first spanwise extending web.

24. A cooler lid, said cooler lid comprising:

a hollow body having an outside wall, an inside wall, and a peripheral wall joining said outside wall to said inside wall;

said outside wall, inside wall, and peripheral wall defining boundaries of an internal chamber of said lid;

said internal chamber of said lid being located between said inside wall and said outside wall and being surrounded by said peripheral wall;

said internal chamber having a filler port;

said filler port being inset from said peripheral wall;

said filler port having an entrance to said chamber that is intermediate said outside wall and said inside wall;

without regard to orientation of said lid, a first portion of volume of said chamber lies at a level above said entrance of said filler port, and a second portion of volume of said chamber lies at a level below said entrance of said filler port;

said outside wall has at least a first out-of-contour formation formed therein, said first out-of-contour formation defining a drink pocket; and said at least one spanwise extending stiffener of said inside wall has a locally extending portion connecting it to said drink pocket of said outside wall.

* * * * *